US012560362B2

(12) United States Patent
Rached et al.

(10) Patent No.: US 12,560,362 B2
(45) Date of Patent: Feb. 24, 2026

(54) METHOD OF FORMING REFRIGERANT SYSTEMS

(71) Applicant: HONEYWELL INTERNATIONAL INC., Charlotte, NC (US)

(72) Inventors: Wissam Rached, Charlotte, NC (US); Pawel Wisnik, Charlotte, NC (US); Nitin Karwa, Charlotte, NC (US); Nilesh Purohit, Charlotte, NC (US); Kaimi Gao, Charlotte, NC (US); Ankit Sethi, Charlotte, NC (US)

(73) Assignee: Solstice Advanced Materials US, Inc., Morris Plains, NJ (US)

( * ) Notice: Subject to any disclaimer, the term of this patent is extended or adjusted under 35 U.S.C. 154(b) by 157 days.

(21) Appl. No.: 18/108,315

(22) Filed: Feb. 10, 2023

(65) Prior Publication Data

US 2023/0258379 A1 Aug. 17, 2023

Related U.S. Application Data

(60) Provisional application No. 63/309,214, filed on Feb. 11, 2022.

(51) Int. Cl.
*F25B 45/00* (2006.01)
*F25B 5/02* (2006.01)

(52) U.S. Cl.
CPC ..... *F25B 45/00* (2013.01); *F25B 5/02* (2013.01)

(58) Field of Classification Search
CPC .. F25B 45/00; F25B 5/02; F25B 41/24; F25B 2345/001; F25B 2345/002
See application file for complete search history.

(56) References Cited

U.S. PATENT DOCUMENTS

2013/0263611 A1* 10/2013 Kearney ..... F25B 49/02 165/200

FOREIGN PATENT DOCUMENTS

WO WO-2021019687 A1 * 2/2021 ..... C09K 5/044

* cited by examiner

*Primary Examiner* — Ana M Vazquez
(74) *Attorney, Agent, or Firm* — FisherBroyles, LLP

(57) ABSTRACT

Methods for forming an improved, centralized refrigeration systems by: (a) providing an existing refrigeration circuit with an existing high GWP refrigerant; (b) disconnecting the fluid connection between the existing refrigerant liquid from the condenser and the evaporators; (c) disconnecting the fluid connection between the existing refrigerant vapor from the evaporators and the compressor suction; (d) establishing a new first refrigeration circuit comprising the compressor and the condenser; (e) establishing a new second refrigeration circuit comprising the evaporators by removing existing refrigerant from the evaporators and the disconnected conduits and replacing the removed refrigerant with a second refrigerant comprising at least 50% of R1234ze(E) and being Class Al and having an OEL greater than 400 and a GWP of about 150 or less; and thermally interconnecting the new first refrigeration circuit and the new second refrigeration circuit with an inter-circuit heat exchanger.

21 Claims, 6 Drawing Sheets

METHOD OF FORMING REFRIGERANT SYSTEMS

CROSS REFERENCE TO RELATED APPLICATIONS

This invention relates to and claims the priority benefit of U.S. Provisional Application No. 63/309,214, filed Feb. 11, 2022, which is incorporated herein by reference in its entirety.

FIELD OF THE INVENTION

This invention relates to large, centralized refrigeration systems, and in particular to methods of forming improved distributed refrigeration systems based on a sequence of steps for modifying an existing centralized system, such as a centralized supermarket refrigeration system, that uses high global warming refrigerants, such as R404A, chlorodifluoromethane (R-22) and others.

BACKGROUND

Distributed refrigeration systems, such as refrigeration systems for cooled supermarket display cases, have typically employed air-cooled or water-cooled condensers fed by a rack of compressors. In common practice, the compressors are coupled in parallel so that they may be switched on and off in stages to adjust the system cooling capacity to the demands of the load, and the condensers are located outside, typically on the roof, or in a machine room adjacent the shopping area where the refrigeration cases are located.

Within each refrigeration case is an evaporator fed by lines from the condensers through which the expanded refrigerant circulates to cool the case. Since the cases are located on the retail floor of the supermarket and the condensers are located remotely on the roof or in a machine shop not accessible to the consumer, long runs of piping connected by joints, valving and control systems are an essential characteristic of such existing systems.

It is common practice within supermarkets to use separate systems to supply different individual cooling temperature ranges to various retail cases. For example, low temperature cases contain frozen foods, ice cream and the like, and are typically operated to maintain the contents at temperatures in the range of from about −30° C. to about −10° C., while medium temperature refrigeration is for display cases for meat, dairy products, and the like, have a typical target of maintaining the contents from about −10° C. to below about 5° C. These separate low and medium temperature systems typically will each constitute its own centralized refrigeration system, and each will normally employ its own compressor(s) or rack of compressors and its own set of refrigerant conduits to and from the compressors and condensers.

Centralized refrigeration systems have this conventional arrangement, as described generally above, and are very costly to construct and maintain. One significant component of this high cost is the long refrigerant conduit runs. Not only are long conduit runs expensive in terms of hardware and installation costs, but the quantity of refrigerant required to fill the conduits is also a significant factor. The longer the conduit run, the more refrigerant required. Environmental factors add to the cost of such systems. In such systems, it has been common to use refrigerants that perform well from the perspective of heat transfer performance and safety (low or no toxicity and low or no flammability) but are highly disadvantageous from the environmental perspective of having high global warming potentials. For example, the following refrigerants (having the indicated GWP values according to IPCC AR5 have been frequently used in such systems): R404A (GWP=3940), R22 (GWP=1760), R407F (GWP=1674), R448A (GWP=1273), R449A (GWP=1283). Since the fittings in such systems will eventually leak, such environmentally damaging refrigerants will escape to the atmosphere. Moreover, since long conduit runs involve more pipefitting joints, valves and the like that may potentially leak, when a leak does occur, the longer the conduit run, the larger the quantity of high GWP refrigerant will be lost to the atmosphere.

Efforts to address the problem of the environmental deficiencies of such centralized refrigeration systems present a substantial engineering challenge, in part because of the large cost that would be associated with a wholesale replacement of such costly and large systems. Moreover, conventional roof-mounted or machine room condenser/compressor systems provide high levels of efficiency and capacity, and any effort to modify these systems to be more environmentally attractive should desirably maintain this efficiency and capacity.

Several thermodynamic and fluid flow challenges arise in connection with efforts to convert a conventional centralized refrigeration system to be more environmentally friendly while maintaining efficiency and capacity. For example, applicants have come to appreciate that it is very difficult, if not impossible, to identify an environmentally friendly refrigerant (e.g., GWP of about 150 or less (as measured by AR5) that can be simply used in an existing centralize refrigeration system in place of the existing high GWP refrigerant. Previously disclosed replacements for R-22 have been studied and shown to result in a cooling capacity decrease and a power requirement increase, thus resulting in an overall significant reduction in performance. (See WO2020/223196A1). This demonstrates the difficulty of developing a viable solution for this problem.

In addition, it is generally considered either important or essential in many applications, including particularly in many centralized refrigeration systems, to use compositions which are non-flammable. As used herein, the term "non-flammable" refers to compounds or compositions which are determined to be non-flammable as determined in accordance ASTM standard E-681-2009 Standard Test Method for Concentration Limits of Flammability of Chemicals (Vapors and Gases) at conditions described in ASHRAE Standard 34-2016 Designation and Safety Classification of Refrigerants and described in Appendix B1 to ASHRAE Standard 34-2016, which is incorporated herein by reference. Unfortunately, many HFCs which might otherwise be desirable as retrofits for existing centralized refrigeration systems are not non-flammable as that term is used herein. For example, the fluoroalkane difluoroethane (HFC-152a) and the fluoroalkene 1,1,1-trifluoropropene (HFO-1243zf) are each flammable and therefore not viable for use in many applications.

Regarding efficiency in use, it is important to note that a loss in refrigerant thermodynamic performance or energy efficiency may have secondary environmental impacts through increased fossil fuel usage arising from an increased demand for electrical energy.

Applicants have thus come to appreciate that it is possible to achieve significant advantage in the creation of much more environmentally friendly centralized refrigeration systems that are comparable to the old system in terms of thermodynamic performance, refrigerant safety (toxicity and flammability) and with only a relatively low capital cost expenditure in terms of system infrastructure.

SUMMARY

Applicants have found that the above-noted needs, and other needs, can be satisfied by methods for forming an improved, centralized refrigeration system comprising:

(a) providing an existing refrigeration circuit comprising: (i) an existing refrigerant having a GWP of greater than 1200; (ii) a plurality of evaporators located in or near a refrigerated space containing products accessible to consumers and (iii) at least one compressor or rack of compressors and at least one condenser located remotely from said areas accessible to said consumers, wherein said existing refrigerant liquid from said condenser is fluidly connected to said evaporators via conduit(s) and wherein existing refrigerant vapor from said evaporators is returned via conduits to the suction side of said compressor or compressor rack;

(b) disconnecting the fluid connection between said existing liquid refrigerant from said condenser and at least one of said evaporators, preferably substantially all of said evaporators;

(c) disconnecting the fluid connection between said existing refrigerant vapor from said at least one of said evaporators in step (b) and said suction of said compressor or compressor rack;

(d) establishing a new first refrigeration circuit comprising said compressor or compressor rack and said condenser, wherein said existing refrigerant remains in said first refrigeration circuit or is removed and replaced;

(e) establishing a new second refrigeration circuit comprising said at least one of said evaporators, and preferably all of said evaporators, that has been disconnected in steps (b) and (c) by steps comprising: (i) removing said existing refrigerant from said evaporators and at least a portion of said conduits which have been disconnected in steps (b) and (c); (ii) replacing said removed existing refrigerant with a second refrigerant comprising: (1) at least about 50% by weight of R1234ze(E); (2) greater than 0% to about 10% of HFC-134a, HFC-134, HFC-227ea, HFC-125, and combinations of two or more of these; and (3) from about 10% to about 20% by weight of HFO-1336mzz(E), HFO-1224yd(Z), and combinations of these, wherein said second refrigerant: (i) has an Occupational Exposure Limit (OEL) greater than 400; (ii) is classified as class A1 by ASHRAE Standard 34; and (iii) has a GWP of about 150 or less; and (f) thermally interconnecting said new first refrigeration circuit and said new second refrigeration circuit with an inter-circuit heat exchanger in which at least a portion of said refrigerant in said first circuit is vaporized by absorbing heat from said second circuit refrigerant vapor and wherein at least a portion of said second refrigerant vapor is condensed by transferring heat to said first circuit refrigerant liquid.

For the purposes of convenience, compositions according to the present paragraph are referred to herein as System Forming Method 1A.

The present invention also includes methods for forming an improved, large-capacity centralized refrigeration system comprising:

(a) providing an existing refrigeration circuit comprising: (i) an existing refrigerant having a GWP of greater than 1200; (ii) a plurality of evaporators located in or near a refrigerated space containing products accessible to consumers and (iii) at least one compressor or rack of compressors and at least one condenser located remotely from said areas accessible to said consumers, wherein said existing refrigerant liquid from said condenser is fluidly connected to said evaporators via conduit(s) and wherein existing refrigerant vapor from said evaporators is returned via conduits to the suction side of said compressor or compressor rack;

(b) disconnecting the fluid connection between said existing liquid refrigerant from said condenser and at least one of said evaporators, preferably substantially all of said evaporators;

(c) disconnecting the fluid connection between said existing refrigerant vapor from said at least one of said evaporators in step (b) and said suction of said compressor or compressor rack; and (d) establishing a new first refrigeration circuit comprising said compressor or compressor rack and said condenser, wherein said existing refrigerant is removed and replaced with a new first refrigerant different than said existing refrigerant;

(e) establishing a new second refrigeration circuit comprising said at least one of said evaporators, and preferably all of said evaporators, that has been disconnected in steps (b) and (c) by steps comprising: (i) removing said existing refrigerant from said evaporators and at least a portion of said conduits which have been disconnected in steps (b) and (c); and (ii) replacing said removed existing refrigerant with a second refrigerant comprising: (1) at least about 50% by weight of R1234ze(E); (2) from greater than 0% to about 10% of HFC-134a, HFC-134, HFC-227ea, HFC-125, and combinations of two or more of these and combinations of these; and (3) from about 10% to about 50% by weight of one or more single component refrigerants that together have a GWP of less than about 150, wherein said second refrigerant: (i) has an Occupational Exposure Limit (OEL) greater than 40; (ii) is classified as class A1 by ASHRAE Standard 34; (iii) has a GWP of less than about 150; and (iv) has a normal boiling point in the range of from about −40° C. to about 20° C.; and (f) thermally interconnecting said new first refrigeration circuit and said new second refrigeration circuit with a new inter-circuit heat exchanger in which at least a portion of said refrigerant is said first circuit is vaporized by absorbing heat from said second circuit refrigerant vapor and wherein at least a portion of said second refrigerant vapor is condensed by transferring heat to said first circuit liquid.

For the purposes of convenience, compositions according to the present paragraph are referred to herein as System Forming Method 1B.

The present invention also includes methods for forming an improved, large-capacity centralized refrigeration system comprising:

(a) providing an existing refrigeration circuit comprising: (i) an existing refrigerant having a GWP of greater than 1200; (ii) a plurality of open display cases containing evaporators and being located in or near an area accessible to consumers and (iii) at least one compressor or rack of compressors and at least one condenser located remotely from said areas accessible to said consumers, wherein said existing refrigerant liquid from said condenser is fluidly connected to said evaporators via conduit(s) and wherein existing refrigerant vapor from said evaporators is returned via conduits to the suction side of said compressor or compressor rack;

(b) disconnecting the fluid connection between said existing liquid refrigerant from said condenser and at least one of said evaporators, preferably substantially all of said evaporators;

(c) disconnecting the fluid connection between said existing refrigerant vapor from said at least one of said evaporators in step (b) and said suction of said compressor or compressor rack; and (d) establishing a new first refrigeration circuit comprising said compressor or compressor rack and said condenser;

(e) establishing a new second refrigeration circuit comprising said evaporator in at least one of said open display cases that has been disconnected in steps (b) and (c) by steps comprising: (i) removing said existing refrigerant from said evaporator(s) and at least a portion of said conduits which have been disconnected in steps (b) and (c); and (ii) replacing said removed existing refrigerant with a second refrigerant that: (1) has a GWP of less about 150 or less; (2) has a normal boiling point or normal boiling point range of from about −40° C. to about 20° C.; (3) has an Occupational Exposure Limit (OEL) greater than 400; and (4) is classified as class 1A by ASHRAE Standard 34; and (iii) adding an openable closure to said opening in said at least one display case, and preferably all of said display cases; and (f) thermally interconnecting said new first refrigeration circuit and said new second refrigeration circuit with a new inter-circuit heat exchanger in which at least a portion of said refrigerant in said first circuit is vaporized by absorbing heat from said second circuit refrigerant vapor and wherein at least a portion of said second refrigerant vapor is condensed by transferring heat to said first circuit liquid.

For the purposes of convenience, compositions according to the present paragraph are referred to herein as System Forming Method 1C.

The present invention also includes methods for forming an improved, large-capacity centralized refrigeration system comprising:

(a) providing an existing refrigeration circuit comprising: (i) an existing refrigerant having a GWP of greater than 1200; (ii) a plurality of open display cases containing evaporators and being located in or near an area accessible to consumers and (iii) at least one compressor or rack of compressors and at least one condenser located remotely from said areas accessible to said consumers, wherein said existing refrigerant liquid from said condenser is fluidly connected to said evaporators via conduit(s) and wherein existing refrigerant vapor from said evaporators is returned via conduits to the suction side of said compressor or compressor rack;

(b) disconnecting the fluid connection between said existing liquid refrigerant from said condenser and at least one of said evaporators, preferably substantially all of said evaporators;

(c) disconnecting the fluid connection between said existing refrigerant vapor from said at least one of said evaporators in step (b) and said suction of said compressor or compressor rack; and (d) establishing a new first refrigeration circuit comprising said compressor or compressor rack and said condenser;

(e) establishing a new second refrigeration circuit comprising said evaporator in at least one of said open display cases that has been disconnected in steps (b) and (c) by steps comprising: (i) removing said existing refrigerant from said evaporator(s) and at least a portion of said conduits which have been disconnected in steps (b) and (c); and (ii) replacing said removed existing refrigerant with a second refrigerant that: (1) has a GWP of less about 150 or less; (2) has a glide (as defined herein) of less than 5° K; (3) has an Occupational Exposure Limit (OEL) greater than 400; and (4) is classified as class A1 by ASHRAE Standard 34; and (iii) adding an openable closure to said opening in said at least one display case, and preferably all of said display cases; and (f) thermally interconnecting said new first refrigeration circuit and said new second refrigeration circuit with a new inter-circuit heat exchanger in which at least a portion of said refrigerant in said first circuit is vaporized by absorbing heat from said second circuit refrigerant vapor and wherein at least a portion of said second refrigerant vapor is condensed by transferring heat to said first circuit liquid.

For the purposes of convenience, compositions according to the present paragraph are referred to herein as System Forming Method 1D.

The present invention also includes methods for forming an improved, large-capacity centralized refrigeration system comprising:

(a) providing an existing refrigeration circuit comprising: (i) an existing refrigerant having a GWP of greater than 1200; (ii) a plurality of open display cases containing evaporators and being located in or near an area accessible to consumers and (iii) at least one compressor or rack of compressors and at least one condenser located remotely from said areas accessible to said consumers, wherein said existing refrigerant liquid from said condenser is fluidly connected to said evaporators via conduit(s) and wherein existing refrigerant vapor from said evaporators is returned via conduits to the suction side of said compressor or compressor rack;

(b) disconnecting the fluid connection between said existing liquid refrigerant from said condenser and at least one of said evaporators, preferably substantially all of said evaporators;

(c) disconnecting the fluid connection between said existing refrigerant vapor from said at least one of said evaporators in step (b) and said suction of said compressor or compressor rack; and (d) establishing a new first refrigeration circuit comprising said compressor or compressor rack and said condenser by removing said existing refrigerant from said compressor and said condenser and adding a new first refrigerant having a GWP of less than 1200;

(e) establishing a new second refrigeration circuit comprising said evaporator in at least one of said open display cases that has been disconnected in steps (b) and (c) by steps comprising: (i) removing said existing refrigerant from said evaporator(s) and at least a portion of said conduits which have been disconnected in steps (b) and (c); and (ii) replacing said removed existing refrigerant with a second refrigerant that: (1) has a GWP of less about 150 or less; (2) has a glide (as defined herein) of less than 5° K; (3) has a normal boiling point of from about −40° C. to about 20° C.; (3) has an Occupational Exposure Limit (OEL) greater than 400; and (4) is classified as class A1 by ASHRAE Standard 34; and (iii) adding an openable closure to said opening in said at least one display case, and preferably all of said display cases; and (f) thermally interconnecting said new first refrigeration circuit and said new second refrigeration circuit with a new inter-circuit heat exchanger in which at least a portion of said refrigerant in said first circuit is vaporized by absorbing heat from said second circuit refrigerant vapor and wherein at least a portion of said second refrigerant vapor is condensed by transferring heat to said first circuit liquid.

For the purposes of convenience, compositions according to the present paragraph are referred to herein as System Forming Method 1E.

The present invention also includes methods for forming an improved, large-capacity centralized refrigeration system comprising:

(a) providing an existing refrigeration circuit comprising: (i) an existing refrigerant having a GWP of greater than 1200; (ii) a plurality of evaporators located in or near a refrigerated space containing products accessible to consumers and (ii) at least one compressor or rack of compressors and at least one condenser located remotely from said areas accessible to said consumers, wherein said existing refrigerant liquid from said condenser is fluidly connected to said evaporators via conduit(s) and wherein existing refrigerant vapor from said evaporators is returned via conduits to the suction side of said compressor or compressor rack;

(b) disconnecting the fluid connection between said existing liquid refrigerant from said condenser and at least one of said evaporators, preferably substantially all of said evaporators;

(c) disconnecting the fluid connection between said existing refrigerant vapor from said at least one of said evaporators in step (b) and said suction of said compressor rack; and (d) establishing a new first refrigeration circuit comprising said compressor rack and said condenser, wherein said existing refrigerant is removed and replaced with a new first refrigerant different than said existing refrigerant;

(e) establishing a new second refrigeration circuit comprising said at least one of said evaporators, and preferably all of said evaporators, that has been disconnected in steps (b) and (c) by steps comprising: (i) removing said existing refrigerant from said evaporators and at least a portion of said conduits which have been disconnected in steps (b) and (c); and (ii) replacing said removed existing refrigerant with a second refrigerant comprising at least about 50% by weight of R1234ze(E) and: (1) having a GWP of about 150 or less; (2) having a normal boiling point or normal boiling point range of from about −40° C. to 20° C.; (3) being non-flammable according to ASHRAE Standard 34; and (4) having an Occupational Exposure Limit (OEL) greater than 400; and (f) thermally interconnecting said new first refrigeration circuit and said new second refrigeration circuit with a new inter-circuit heat exchanger in which at least a portion of said refrigerant is said first circuit is vaporized by absorbing heat from said second circuit refrigerant vapor and wherein at least a portion of said second refrigerant vapor is condensed by transferring heat to said first circuit liquid.

For the purposes of convenience, compositions according to the present paragraph are referred to herein as System Forming Method 2A.

The present invention also includes methods for forming an improved, large-capacity centralized refrigeration system comprising:

(a) providing an existing refrigeration circuit comprising: (i) an existing refrigerant having a GWP of greater than 1200; (ii) a plurality of open display cases containing evaporators and being located in or near an area accessible to consumers and (iii) at least one rack of compressors and at least one condenser located remotely from said areas accessible to said consumers, wherein said existing refrigerant liquid from said condenser is fluidly connected to said evaporators via conduit(s) and wherein existing refrigerant vapor from said evaporators is returned via conduits to the suction side of said compressor rack;

(b) disconnecting the fluid connection between said existing liquid refrigerant from said condenser and at least one of said evaporators, preferably substantially all of said evaporators;

(c) disconnecting the fluid connection between said existing refrigerant vapor from said at least one of said evaporators in step (b) and said suction of said compressor or compressor rack; and (d) establishing a new first refrigeration circuit comprising said compressor rack and said condenser, wherein said existing refrigerant is removed and replaced with a new first refrigerant different than said existing refrigerant;

(e) establishing a new second refrigeration circuit comprising said at least one of said evaporators, and preferably all of said evaporators, that has been disconnected in steps (b) and (c) by steps comprising: (i) removing said existing refrigerant from said evaporators and at least a portion of said conduits which have been disconnected in steps (b) and (c); and (ii) replacing said removed existing refrigerant with a second refrigerant comprising at least about 50% by weight of R1234ze(E) and (1) having a GWP of less than about 150; (2) having a normal boiling point or normal boiling point range of from about −40° C. to 20° C.; (2) having a glide (as defined herein) of less than 5° K; (4) being non-flammable according to ASHRAE Standard 34; and (5) having an Occupational Exposure Limit (OEL) greater than 400; and (f) thermally interconnecting said new first refrigeration circuit and said new second refrigeration circuit with a new inter-circuit heat exchanger in which at least a portion of said refrigerant is said first circuit is vaporized by absorbing heat from said second circuit refrigerant vapor and wherein at least a portion of said second refrigerant vapor is condensed by transferring heat to said first circuit liquid.

For the purposes of convenience, compositions according to the present paragraph are referred to herein as System Forming Method 2B.

DETAILED DESCRIPTION

Definitions

Figure 1:
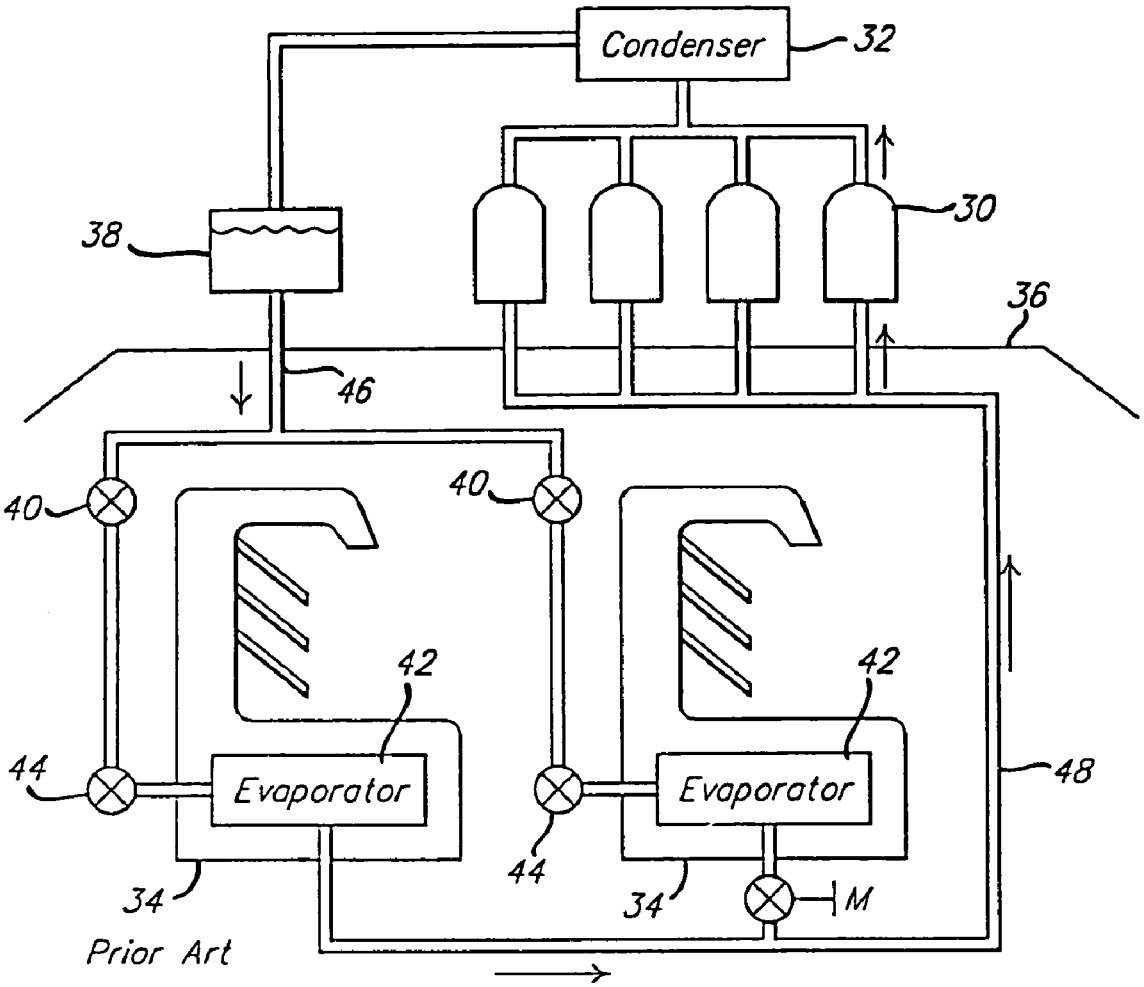
FIG. 1 is a semi-schematic process flow diagram showing a centralized refrigeration system according to the prior art.

For the purposes of this invention, the term "about" in relation to the amounts expressed in weight percent for amounts greater than 2% means that the amount of the component can vary by an amount of +/−2% by weight.

For the purposes of this invention, the term "about" in relation to temperatures in degrees centigrade (° C.) means that the stated temperature can vary by an amount of +/−5° C.

For the purposes of this invention, the term "about" in relation to percentage of power usage means that the stated percentage can vary by an amount of up to 1%.

For the purposes of this invention, the term "substantial portion" in relation to removal of an existing refrigerant from a heat transfer system means removing at least about 50% of the existing refrigerant contained in the system.

The term "capacity" is the amount of cooling provided, in BTUs/hr. or kW, by the refrigerant in the refrigeration system. This is experimentally determined by multiplying the change in enthalpy in BTU/lb., or kJ/kg, of the refrigerant as it passes through the evaporator by the mass flow rate of the refrigerant. The enthalpy can be determined from the measurement of the pressure and temperature of the refrigerant. The capacity of the refrigeration system relates to the ability to maintain an area to be cooled at a specific temperature. The capacity of a refrigerant represents the amount of cooling or heating that it provides and provides some measure of the capability of a compressor to pump quantities of heat for a given volumetric flow rate of refrigerant. In other words, given a specific compressor, a refrigerant with a higher capacity will deliver more cooling or heating power.

The phrase "coefficient of performance" (hereinafter "COP") is a universally accepted measure of refrigerant performance, especially useful in representing the relative thermodynamic efficiency of a refrigerant in a specific heating or cooling cycle involving evaporation or condensation of the refrigerant. In refrigeration engineering, this term expresses the ratio of useful refrigeration or cooling capacity to the energy applied by the compressor in compressing the vapor and therefore expresses the capability of a given compressor to pump quantities of heat for a given volumetric flow rate of a heat transfer fluid, such as a refrigerant. In other words, given a specific compressor, a refrigerant with a higher COP will deliver more cooling or heating power. One means for estimating COP of a refrigerant at specific operating conditions is from the thermodynamic properties of the refrigerant using standard refrigeration cycle analysis techniques (see for example, R. C. Downing, FLUOROCARBON REFRIGERANTS HANDBOOK, Chapter 3, Prentice-Hall, 1988 which is incorporated herein by reference in its entirety).

The phrase "discharge temperature" refers to the temperature of the refrigerant at the outlet of the compressor. The advantage of a low discharge temperature is that it permits the use of existing equipment without activation of the thermal protection aspects of the system which are preferably designed to protect compressor components and avoids the use of costly controls such as liquid injection to reduce discharge temperature.

The term "centralized refrigeration system" as used herein means a refrigeration system that includes one or more centrally located compressors or rack of compressors and one or more centrally located condensers, and a plurality of evaporators located remotely from said centralized compressor or rack of compressors and which receive liquid refrigerant from said centrally located condenser(s).

"Direct Expansion" as used herein means heat transfer systems which utilize evaporators in which the liquid refrigerant enters the evaporator and flows through coils (preferably tubular coils) and vaporizes as heat is absorbed from air circulating in the display case, and which uses a thermostatic expansion valve at the inlet of the evaporator and which is controlled to feed enough refrigerant to result in substantially all of the refrigerant being evaporated at the evaporator outlet and to optionally have a predetermined amount of super heat at the exit.

The phrase "Global Warming Potential" (hereinafter "GWP") was developed to allow comparisons of the global warming impact of different gases, and as used herein refers to GWP as determine by AR5 as describe above. Specifically, it is a measure of how much energy the emission of one ton of a gas will absorb over a given period of time, relative to the emission of one ton of carbon dioxide. The larger the GWP, the more that a given gas warms the Earth compared to CO2 over that time period. The time period usually used for GWP is 100 years. GWP provides a common measure, which allows analysts to add up emission estimates of different gases. See http://www.protocolodemontreal.org.br/site/images/publicacoes/setor_manufatura_equipamentos_refrigeracao_arcondicionado/Como_calcular_el_Potencial_de_Calentamiento_Atmosferico_en_las_mezclas_de_refrigerantes.pdf The term "Occupational Exposure Limit (OEL)" is determined in accordance with ASHRAE Standard 34-2016 Designation and Safety Classification of Refrigerants.

The phrase "acceptable toxicity" as used herein means the composition is classified as class "A" by ASHRAE Standard 34-2016 Designation and Safety Classification of Refrigerants and described in Appendix B1 to ASHRAE Standard 34-2016 (as each standard exists as of the filing date of this application). A substance which is non-flammable and low toxicity would be classified as "A1" by ASHRAE Standard 34-2016 Designation and Safety Classification of Refrigerants and described in Appendix B1 to ASHRAE Standard 34-2016 (as each standard exists as of the filing date of this application).

The term "mass flow rate" is the mass of refrigerant passing through a conduit per unit of time.

As used herein, the term "replacement" means the use of a composition of the present invention in a heat transfer system that had been designed for use with or is suitable for use with another refrigerant. By way of example, when a refrigerant or heat transfer composition of the present invention is used in a heat transfer system that was designed for use with R-410A, then the refrigerant or heat transfer composition of the present invention is a replacement for R-410A in said system. It will thus be understood that the term "replacement" includes the use of the refrigerants and heat transfer compositions of the present invention in both new and existing systems that had been designed for use with, are commonly used with, or are suitable for use with R-410A.

The term "glide" applies to zeotropic refrigerant mixtures that have varying temperatures during phase change processes in the evaporator or condenser at constant pressure and are quantified herein as the difference between the saturated vapor temperature and the saturated liquid temperature at pressure of 100 kPa.

The term "low temperature refrigeration system" refers to heat transfer systems which operate with a condensing temperature of from about 40° C. to about 70° C. and evaporating temperature of from about −45° C. up to and including −12° C.

The term "medium temperature refrigeration system" refers to heat transfer systems which operate with a condensing temperature of from about 40° C. to about 70° C. and evaporating temperature of from −12° C. to about 0° C.

The term "supermarket refrigeration" as used herein refers to commercial refrigeration systems that are used to maintain chilled or frozen food in both product display cases and storage refrigerators.

The term "normal boiling point" refers to the boiling point of a single component measured at 1 atmosphere of pressure and refers to the initial boiling point of a blend of components at 1 atmosphere.

The term "R22" means chlorodifluoromethane.

The terms "HFC32" and "R32" as used herein each mean difluoromethane.

The terms "HFC-125" and "R125" mean pentafluoroethane.

The terms "HFC-134a" and "R134a" means 1,1,1,2-tetrafluoroethane.

The terms "HFC-134" and "R134" means 1,1,2,2-tetrafluoroethane.

The term "R143a" means 1,1,1-trifluoroethane.

The term R290 means propane.

The term "R404A" means a combination of about 44% by weight of R-125, about 52% by weight of R143a and about 4% by weight of R-134a.

The term "R407A" means a combination of about 20% by weight of R-32, about 40% by weight of R125, and about 40% by weight of R-134a.

The term "R407B" means a combination of about 10% by weight of R-32, about 70% by weight of R125, and about 20% by weight of R-134a.

The term "R407C" means a combination of about 23% by weight of R-32, about 25% by weight of R125, and about 52% by weight of R-134a.

The term "R407D" means a combination of about 15% by weight of R-32, about 15% by weight of R125, and about 70% by weight of R-134a.

The term "R407F" means a combination of about 40% by weight of R-32, about 30% by weight of R125, and about 30% by weight of R-134a.

The term "R407" means any of R407A, R407B, R407C, R407D and R407F.

The term "R448A" means a combination of about 26% by weight of R-32, about 26% by weight of R125, and about 21% by weight of R-134a.

The term "R448A" means a combination of about 26% by weight of R-32, about 26% by weight of R125, and about 21% by weight of R-134a.

The term "R448" means a refrigerant designated as R448 with any letter designation, including R448A.

The term "R449A" means a combination of about 24.3% by weight of R-32, about 24.7% by weight of R125, and about 25.7% by weight of R-134a.

The term "R449" means a refrigerant designated as R449 with any letter designation, including R449A.

The term "R454B" means a combination of about 68.9% by weight of R-32 and about 31.1% by weight of R1234yf.

The term "R454" means a refrigerant designated as R454 with any letter designation, including R454B.

The term "R513A" means a combination of about 44% by weight of R-134a and about 56% by weight of R1234yf.

The term "R449" means a refrigerant designated as R449 with any letter designation, including R449A.

The terms "HFO1234yf" and "R1234yf" as used herein each mean 2,3,3,3-tetrafluoropropene.

The terms "HFO1234ze(E)," R1234ze(E) and "1234ze (E)" as used herein each mean trans-1,3,3,3-tetrafluoropropene.

Reference herein to a group of defined items includes all such defined items, including all such items with suffix designations.

Systems and Methods

The methods of the present invention generally comprise a first step of providing an existing centralized refrigeration system. A schematic example of such a centralized refrigeration system is illustrated in FIG. 1, which shows a system that includes a rack of compressors 30, a condenser 32, an accumulator 38 and a series of display cases 34, each containing an evaporator 42. A high GWP refrigerant, such as R-404a, circulates in such system through a network of piping 46 carrying liquid refrigerant and a network of piping 48 carrying refrigerant vapor. Although shown schematically in FIG. 1, in practice each of these piping networks generally represents an extensive and long series of conduits for transporting the liquid refrigerant from the accumulator 38, which is generally placed, along with the compressor rack 30 and the condenser 32, at a location that is remote from the display cases. Thus, the piping network 46 is large, covering the distance from, for example, the roof or machine room of a supermarket to spreading over the supermarket floor in order to reach the multitude of display cases located there. While FIG. 1 shows just two (2) display cases, those skilled in the art will appreciate that in many circumstances from 1 up to about 150 display cases per circuit distributed over a large consumer retail area that needs to be reached by the liquid piping network 46, and an equally large vapor return piping network 48 would be required to return the refrigerant vapor in each of those cases to the rooftop or machine room. In many applications, the length of piping needed for the liquid feed from and vapor return to the compressor is at least about 20 meters (65 feet).

It will also be appreciated by those skilled in the art that while the compressor rack in FIG. 1 is depicted as having four compressors 30, in practice the compressor rack can comprise from one (1) compressor up to about 5 compressors, depending on individual applications. Put another way, the existing refrigerant systems that are provided according to the present invention can represent a compressor work capacity of from about 3 kW to about 500 kW. With respect to the type of compressor, it is contemplated that all types of compressors can be present in such systems, but in many of such systems the compressors which are used are selected from screw compressors, scroll compressors, reciprocating compressors, centrifugal compressors, dual screw compressors and combinations of these.

The existing refrigerants that are used in the existing centralized refrigeration systems of the present invention generally have a GWP of 1200 or greater (determined according to AR5), and include R404A, R22 and R407 (including each of R407A, R407B, R407C, R407D), R448 (all letter designations) and R449 (all letter designations).

The present invention involves improving systems of the type disclosed in FIG. 1 to improve the environmental friendliness of the system. The preferred methods include the steps of disconnecting the liquid connection between the condenser and at least one of, and preferably all of the evaporators, and also disconnecting the vapor connection between the evaporators and suction of the compressor(s). With reference, for example to FIGS. 2A, 2B and 2C, the liquid line 14 is disconnect, preferably just downstream of the accumulator 13 so as to separate the liquid side of the evaporators from the liquid from the condenser 12, and the vapor line 15 is disconnected, preferably just upstream of the compressor(s) so as to separate the vapor side of the evaporator(s) from the compressor(s). This disconnecting step thus enables the conversion of the existing single refrigeration circuit to a new first refrigeration circuit and new second refrigeration circuit (see for example 10A and 10B, respectively, in FIG. 3C). As used herein in this context, the term "new" is understood to mean only that the circuits that are defined by the present invention did not previously exist, but it will be understood that one objective of the present invention is to utilize a large proportion of the "old" piping network and the "old" evaporator(s) as part of the new second refrigeration circuit. In certain preferred embodiments, it is also an object to use the "old" compressor(s), condenser and accumulator and the piping and valving therebetween to form the second new refrigeration circuit.

Either prior to, simultaneous with or after the disconnecting step, the existing refrigerant is removed from the liquid and vapor piping network that remains connected to the evaporators, as well as the evaporators themselves and all other piping, valving, and the like that will be used to form the new second refrigeration circuit, such as circuit 10B in FIG. 3C. The preferred second circuit, an example of which is shown in FIG. 3C, is formed by including a liquid pump 21, which in preferred embodiments is fed with cool, liquid refrigerant by an accumulator 22. The pump provides the motive force to transport the second refrigerant to each of the evaporators that have been disconnected from the compressor. The liquid refrigerant in the second circuit 10B provides cooling to the display cases as it is vaporized in the evaporator by absorbing heat from the air and/or products in the display cases.

An important aspect of the present invention is that the vapor from the evaporators is not returned to the compressor(s), as would have been the case with the original system, but instead the present invention involves the step of thermally interconnecting the new first refrigeration circuit 10A and said new second refrigeration circuit 10B with a new inter-circuit heat exchanger 20. The vapor from the evaporators travels to this inter-circuit heat exchanger in which at least a portion of said second refrigerant is condensed by transferring heat to the liquid refrigerant leaving the condenser in the new first circuit and thereby vaporizing the first refrigerant and producing refrigerant to feed the compressor 11 of the first circuit. In this arrangement, the inter-circuit heat exchanger acts as an evaporator in said first circuit and as a condenser in said second circuit.

Importantly, the present methods involve using in said new second circuit a low GWP refrigerant which has a GWP of 150 or less and which also preferably is a Class A1 refrigerant with an OEL greater than 400 and has a normal boiling point of −40° C. to 20° C. The following Table A identifies four refrigerant blends A1, A2, A3 and A3' that satisfy these criteria and provide substantial an unexpected advantage in accordance with the present invention, it being understood that the amounts in the table are considered to all be preceded by "about":

TABLE A

| Refrigerant → | A1 | A2 | A3 | A3' |
|---|---|---|---|---|
| | Concentration, wt. % | | | |
| Component | | | | |
| HFO-1234ze(E) | 78.7 | 78 | 83.5 | 77 |
| HFO-1336mzz(E) | 17 | 12 | 0 | 0 |
| HFO-1224yd(Z) | 0 | 0 | 6.5 | 13 |
| HFC-227ea | 4.3 | 0 | 0 | 0 |
| HFC-134a | 0 | 10 | 10 | 10 |
| Total | 100 | 100 | 100 | 100 |
| ASHRAE Name | R-471A | 476A | No ASHRAE name | No ASHRAE name |
| Properties | | | | |
| Normal Point, ° C. | −16.9 | −19.1 | −19.6 | −18.7 |
| Glide, ° K | 3.0 | 2.9 | 2.6 | 4.4 |
| GWP (as per AR5) | 148 | 133 | 131 | 131 |

In preferred embodiments, the refrigerant in the second circuit is selected from within the ranges of components specified in the following Table B, it being understood that the amounts in the table are considered to all be preceded by "about":

| | Refrigerant | | | | | |
|---|---|---|---|---|---|---|
| | B1 | B2 | B3 | B4 | B5 | B6 |
| Component | Concentration, wt. % | | | | | |
| HFO-1234ze(E) | 70-85 | 70-85 | 70-85 | 75-85 | 75-85 | 75-85 |
| HFO-1336mzz(E) | 10-25 | 10-25 | 0-5 | 15-20 | 10-15 | 0 |
| HFO-1224yd(Z) | 0-5 | 0-5 | 5-20 | 0-5 | 0-5 | 5-15 |
| HFC-227ea | 3-4.4 | 0-5 | 0-5 | 3-4.4 | 0-5 | 0-5 |
| HFC-134a | 0-5 | 5-15 | 6-10 | 0-5 | 8-10 | 6-10 |
| Total | 100 | 100 | 100 | 100 | 100 | 100 |

In preferred embodiments, the refrigerant in the second circuit has a normal boiling point within the ranges specified in the following Table C, it being understood that the amounts in the table are considered to all be preceded by "about":

| Refrigerant → | C1 | C2 | C3 |
|---|---|---|---|
| Normal Boiling Point range, ° C. | −40 to 20 | −20 to 20 | −20 to −12 |

In preferred embodiments, the refrigerant in the second circuit has a glide within the ranges specified in the following Table D, it being understood that the amounts in the table are considered to all be preceded by "about":

| Refrigerant → | D1 | D2 | D3 |
|---|---|---|---|
| Glide, ° K | <=5 | <=4 | <=3 |

Refrigerant Combinations

It is contemplated that the existing refrigerant that is contained in the piping and equipment associated with the condenser and compressors (i.e., the new first refrigeration circuit) can remain and be used as the refrigerant for the new first circuit, or it can be removed and replaced in whole or in part with a new, preferably lower GWP refrigerant. In those embodiments in which the existing refrigerant in the new first circuit remains, it is contemplated that the existing equipment, including the compressor(s), condenser(s), accumulators, connective piping, and the like will also not need to be replaced. Such embodiments have the advantage of minimizing incremental capital equipment cost but will result in a high GWP refrigerant being utilized in the new first refrigeration circuit. While such an arrangement has a significant environmental advantage because the amount of high GWP refrigerant being used in converted system is greatly reduce compared to the original system, in another embodiment the existing refrigerant is removed from the compressor(s), condenser(s), accumulators, connective piping and the like, and a new low GWP refrigerant is used to replace all or substantially all, or some other portion of the existing refrigerant. In such embodiments it is likely that one or more, or all, of those pieces of the system will need to be replaced and/or modified, which in turn increases capital expenditures. However, proceeding according to the embodiments in which the high GWP refrigerant is removed from the first circuit provides the most desirable result from an environmental standpoint since it provides a converted system in which only low GWP refrigerant is used. In general, for such embodiments, the new refrigerant for the first circuit will have a GWP of less than 150, more preferably less than 100 and even more preferably less than about 25. Examples of low GWP refrigerants to use in the new first refrigerant circuit in such embodiments include 1234ze(E), 1234yf and blends containing these.

As will be appreciated by those skilled in the art, the present invention includes heat transfer system forming methods which combine a wide scope of existing centralized refrigeration systems having existing refrigerants and a variety of specific refrigerants that may be used in the new second circuit, and the optionally as a replacement for the existing refrigerant in the new first circuit. The possible combinations include the methods of the present invention, including each of the methods defined by System Forming Methods 1 through 2, are described in the following Table C. As used herein, it is intended and understood that reference to a defined systems forming method by number, such as System Forming Method 1, includes each of such numbered reference with a suffix. Thus, for example, reference to System Forming Method 1 includes specific reference to each of System Forming Methods 1A through 1E. Furthermore, the systems forming methods as numbered in the first column of the following table are understood to be a definition of the indicated numbered system forming method.

TABLE C

| System Forming Method No. | Existing Refrigerant | Refrigerant in New First Circuit | Refrigerant in New Second Circuit |
|---|---|---|---|
| 3A | R404A | R404A | A1 (R471A) |
| 3B | R404A | R404A | A2 (R476A) |
| 3C | R404A | R404A | A3 |
| 3C' | R404A | R404A | A3' |
| 3D | R404A | R404A | B1 |
| 3E | R404A | R404A | B2 |
| 3F | R404A | R404A | B3 |
| 3G | R404A | R404A | B4 |
| 3H | R404A | R404A | B5 |
| 3I | R404A | R404A | B6 |
| 4A | R404A | R1234ze(E) | A1 (R471A) |
| 4B | R404A | R1234ze(E) | A2 (R476A) |
| 4C | R404A | R1234ze(E) | A3 |
| 4C' | R404A | R1234ze(E) | A3' |
| 4D | R404A | R1234ze(E) | B1 |
| 4E | R404A | R1234ze(E) | B2 |
| 4F | R404A | R1234ze(E) | B3 |
| 4G | R404A | R1234ze(E) | B4 |
| 4H | R404A | R1234ze(E) | B5 |
| 4I | R404A | R1234ze(E) | B6 |
| 5A | R404A | R290 | A1 (R471A) |
| 5B | R404A | R290 | A2 (R476A) |
| 5C | R404A | R290 | A3 |
| 5C' | R404A | R290 | A3' |
| 5D | R404A | R290 | B1 |
| 5E | R404A | R290 | B2 |
| 5F | R404A | R290 | B3 |
| 5G | R404A | R290 | B4 |
| 5H | R404A | R290 | B5 |
| 5I | R404A | R290 | B6 |
| 6A | R407 | R407 | A1 |
| 6B | R407 | R407 | A2 (R476A) |
| 6C | R407 | R407 | A3 |
| 6C' | R407 | R407 | A3' |
| 6D | R407 | R407 | B1 |
| 6E | R407 | R407 | B2 |
| 6F | R407 | R407 | B3 |
| 6G | R407 | R407 | B4 |
| 6H | R407 | R407 | B5 |
| 6I | R407 | R407 | B6 |
| 7A | R407 | R1234ze(E) | A1 (R471A) |
| 7B | R407 | R1234ze(E) | A2 (R476A) |
| 7C | R407 | R1234ze(E) | A3 |
| 7C' | R407 | R1234ze(E) | A3' |
| 7D | R407 | R1234ze(E) | B1 |
| 7E | R407 | R1234ze(E) | B2 |
| 7F | R407 | R1234ze(E) | B3 |
| 7G | R407 | R1234ze(E) | B4 |
| 7H | R407 | R1234ze(E) | B5 |
| 7I | R407 | R1234ze(E) | B6 |
| 8A | R407 | R290 | A1 (R471A) |
| 8B | R407 | R290 | A2 (R476A) |
| 8C | R407 | R290 | A3 |
| 8C' | R407 | R290 | A3' |
| 8D | R407 | R290 | B1 |
| 8E | R407 | R290 | B2 |
| 8F | R407 | R290 | B3 |
| 8G | R407 | R290 | B4 |
| 8H | R407 | R290 | B5 |
| 8I | R448 | R290 | B6 |
| 9A | R448 | R448 | A1 (R471A) |
| 9B | R448 | R448 | A2 (R476A) |
| 9C | R448 | R448 | A3 |
| 9C' | R448 | R448 | A3' |
| 9D | R448 | R448 | B1 |
| 9E | R448 | R448 | B2 |
| 9F | R448 | R448 | B3 |
| 9G | R448 | R448 | B4 |
| 9H | R448 | R448 | B5 |
| 9I | R448 | R448 | B6 |
| 10A | R448 | R1234ze(E) | A1 (R471A) |
| 10B | R448 | R1234ze(E) | A2 (R476A) |
| 10C | R448 | R1234ze(E) | A3 |
| 10C' | R448 | R1234ze(E) | A3' |
| 10D | R448 | R1234ze(E) | B1 |
| 10E | R448 | R1234ze(E) | B2 |
| 10F | R448 | R1234ze(E) | B3 |

TABLE C-continued

| System Forming Method No. | Existing Refrigerant | Refrigerant in New First Circuit | Refrigerant in New Second Circuit |
|---|---|---|---|
| 10G | R448 | R1234ze(E) | B4 |
| 10H | R448 | R1234ze(E) | B5 |
| 10I | R448 | R1234ze(E) | B6 |
| 11A | R448 | R290 | A1 (R471A) |
| 11B | R448 | R290 | A2 (R476A) |
| 11C | R448 | R290 | A3 |
| 11C' | R448 | R290 | A3' |
| 11D | R448 | R290 | B1 |
| 11E | R448 | R290 | B2 |
| 11F | R448 | R290 | B3 |
| 11G | R448 | R290 | B4 |
| 11H | R448 | R290 | B5 |
| 11I | R448 | R290 | B6 |
| 12A | R449 | R449 | A1 (R471A) |
| 12B | R449 | R449 | A2 (R476A) |
| 12C | R449 | R449 | A3 |
| 12C' | R449 | R449 | A3' |
| 12D | R449 | R449 | B1 |
| 12E | R449 | R449 | B2 |
| 12F | R449 | R449 | B3 |
| 12G | R449 | R449 | B4 |
| 12H | R449 | R449 | B5 |
| 12I | R449 | R449 | B6 |
| 13A | R449 | R1234ze(E) | A1 (R471A) |
| 13B | R449 | R1234ze(E) | A2 (R476A) |
| 13C | R449 | R1234ze(E) | A3 |
| 13C' | R449 | R1234ze(E) | A3' |
| 13D | R449 | R1234ze(E) | B1 |
| 13E | R449 | R1234ze(E) | B2 |
| 13F | R449 | R1234ze(E) | B3 |
| 13G | R449 | R1234ze(E) | B4 |
| 13H | R449 | R1234ze(E) | B5 |
| 13I | R449 | R1234ze(E) | B6 |
| 14A | R449 | R290 | A1 (R471A) |
| 14B | R449 | R290 | A2 (R476A) |
| 14C | R449 | R290 | A3 |
| 14C' | R449 | R290 | A3' |
| 14D | R449 | R290 | B1 |
| 14E | R449 | R290 | B2 |
| 14F | R449 | R290 | B3 |
| 14G | R449 | R290 | B4 |
| 14H | R449 | R290 | B5 |
| 14I | R449 | R290 | B6 |
| 15A | R454 | R454 | A1 (R471A) |
| 15B | R454 | R454 | A2 (R476A) |
| 15C | R454 | R454 | A3 |
| 15C' | R454 | R454 | A3' |
| 15D | R454 | R454 | B1 |
| 15E | R454 | R454 | B2 |
| 15F | R454 | R454 | B3 |
| 15G | R454 | R454 | B4 |
| 15H | R454 | R454 | B5 |
| 15I | R454 | R454 | B6 |
| 16A | R454 | R1234ze(E) | A1 (R471A) |
| 16B | R454 | R1234ze(E) | A2 (R476A) |
| 16C | R454 | R1234ze(E) | A3 |
| 16C' | R454 | R1234ze(E) | A3' |
| 16D | R454 | R1234ze(E) | B1 |
| 16E | R454 | R1234ze(E) | B2 |
| 16F | R454 | R1234ze(E) | B3 |
| 16G | R454 | R1234ze(E) | B4 |
| 16H | R454 | R1234ze(E) | B5 |
| 16I | R454 | R1234ze(E) | B6 |
| 17A | R454 | R290 | A1 (R471A) |
| 17B | R454 | R290 | A2 (R476A) |
| 17C | R454 | R290 | A3 |
| 17C' | R454 | R290 | A3' |
| 17D | R454 | R290 | B1 |
| 17E | R454 | R290 | B2 |
| 17F | R454 | R290 | B3 |
| 17G | R454 | R290 | B4 |
| 17H | R454 | R290 | B5 |
| 17I | R454 | R290 | B6 |
| 18A | R513 | R513 | A1 (R471A) |
| 18B | R513 | R513 | A2 (R476A) |
| 18C | R513 | R513 | A3 |
| 18C' | R513 | R513 | A3' |

TABLE C-continued

| System Forming Method No. | Existing Refrigerant | Refrigerant in New First Circuit | Refrigerant in New Second Circuit |
|---|---|---|---|
| 18D | R513 | R513 | B1 |
| 18E | R513 | R513 | B2 |
| 18F | R513 | R513 | B3 |
| 18G | R513 | R513 | B4 |
| 18H | R513 | R513 | B5 |
| 18I | R513 | R513 | B6 |
| 19A | R513 | R1234ze(E) | A1 (R471A) |
| 19B | R513 | R1234ze(E) | A2 (R476A) |
| 19C | R513 | R1234ze(E) | A3 |
| 19C' | R513 | R1234ze(E) | A3' |
| 19D | R513 | R1234ze(E) | B1 |
| 19E | R513 | R1234ze(E) | B2 |
| 19F | R513 | R1234ze(E) | B3 |
| 19G | R513 | R1234ze(E) | B4 |
| 19H | R513 | R1234ze(E) | B5 |
| 19I | R513 | R1234ze(E) | B6 |
| 20A | R513 | R290 | A1 (R471A) |
| 20B | R513 | R290 | A2 (R476A) |
| 20C | R513 | R290 | A3 |
| 20C' | R513 | R290 | A3' |
| 20D | R513 | R290 | B1 |
| 20E | R513 | R290 | B2 |
| 20F | R513 | R290 | B3 |
| 20G | R513 | R290 | B4 |
| 20H | R513 | R290 | B5 |
| 20I | R513 | R290 | B6 |
| 21A | R455 | R513 | A1 (R471A) |
| 21B | R455 | R455 | A2 (R476A) |
| 21C | R455 | R455 | A3 |
| 20C' | R513 | R290 | A3' |
| 21D | R455 | R455 | B1 |
| 21E | R455 | R455 | B2 |
| 21F | R455 | R455 | B3 |
| 21G | R455 | R455 | B4 |
| 21H | R455 | R455 | B5 |
| 21I | R455 | R455 | B6 |
| 22A | R455 | R1234ze(E) | A1 (R471A) |
| 22B | R455 | R1234ze(E) | A2 (R476A) |
| 22C | R455 | R1234ze(E) | A3 |
| 22C' | R455 | R1234ze(E) | A3' |
| 22D | R455 | R1234ze(E) | B1 |
| 22E | R455 | R1234ze(E) | B2 |
| 22F | R455 | R1234ze(E) | B3 |
| 22G | R455 | R1234ze(E) | B4 |
| 22H | R455 | R1234ze(E) | B5 |
| 22I | R455 | R1234ze(E) | B6 |
| 23A | R455 | R290 | A1 (R471A) |
| 23B | R455 | R290 | A2 (R476A) |
| 23C | R455 | R290 | A3 |
| 23C' | R455 | R290 | A3' |
| 23D | R455 | R290 | B1 |
| 23E | R455 | R290 | B2 |
| 23F | R455 | R290 | B3 |
| 23G | R455 | R290 | B4 |
| 23H | R455 | R290 | B5 |
| 23I | R455 | R290 | B6 |
| 24A | R22 | R22 | A1 (R471A) |
| 24B | R22 | R22 | A2 (R476A) |
| 24C | R22 | R22 | A3 |
| 24C' | R22 | R22 | A3' |
| 24D | R22 | R22 | B1 |
| 24E | R22 | R22 | B2 |
| 24F | R22 | R22 | B3 |
| 24G | R22 | R22 | B4 |
| 24H | R22 | R22 | B5 |
| 24I | R22 | R22 | B6 |
| 25A | R22 | R1234ze(E) | A1 (R471A) |
| 25B | R22 | R1234ze(E) | A2 (R476A) |
| 25C | R22 | R1234ze(E) | A3 |
| 25C' | R22 | R1234ze(E) | A3'' |
| 25D | R22 | R1234ze(E) | B1 |
| 25E | R22 | R1234ze(E) | B2 |
| 25F | R22 | R1234ze(E) | B3 |
| 25G | R22 | R1234ze(E) | B4 |
| 25H | R22 | R1234ze(E) | B5 |
| 25I | R22 | R1234ze(E) | B6 |
| 26A | R22 | R290 | A1 (R471A) |

TABLE C-continued

| System Forming Method No. | Existing Refrigerant | Refrigerant in New First Circuit | Refrigerant in New Second Circuit |
|---|---|---|---|
| 26B | R22 | R290 | A2 (R476A) |
| 26C | R22 | R290 | A3 |
| 26C' | R22 | R290 | A3' |
| 26D | R22 | R290 | B1 |
| 26E | R22 | R290 | B2 |
| 26F | R22 | R290 | B3 |
| 26G | R22 | R290 | B4 |
| 26H | R22 | R290 | B5 |
| 26I | R22 | R290 | B6 |

Equipment

The present methods, including each of System Forming Methods 1-26, includes a step of forming a new second refrigeration circuit comprising adding a liquid pump fluidly connected between the liquid second refrigerant exiting the inter-circuit heat exchanger and the inlet of the second circuit evaporator.

The present methods, including each of System Forming Methods 1-26, includes a step of forming a new second refrigeration circuit comprising including a liquid ejector fluidly connected between the vapor exiting the second refrigerant evaporator and the inlet to the inter-circuit heat exchanger.

The present methods, including each of System Forming Methods 1-26, includes a step of forming a new second refrigeration circuit comprising: (a) including a liquid pump fluidly connected between the liquid second refrigerant exiting the inter-circuit heat exchanger and the inlet of the second circuit evaporator; and (b) including a liquid ejector fluidly connected between the vapor exiting the second refrigerant evaporator and the inlet to the inter-circuit heat exchanger.

The present methods, including each of System Forming Methods 1-26, includes a step of forming a new second refrigeration circuit comprising including a thermostatic expansion valve at the inlet of the evaporator.

The present methods, including each of System Forming Methods 1-26, includes a step of forming a new second refrigeration circuit comprising including: (a) liquid pump fluidly connected between the liquid second refrigerant exiting the inter-circuit heat exchanger and the inlet of the second circuit evaporator; and (b) including a thermostatic expansion valve at the inlet of the evaporator.

The present methods, including each of System Forming Methods 1-26, includes a step of forming a new second refrigeration circuit comprising: (a) including a liquid pump fluidly connected between the liquid second refrigerant exiting the inter-circuit heat exchanger and the inlet of the second circuit evaporator; (b) including a liquid ejector fluidly connected between the vapor exiting the second refrigerant evaporator and the inlet to the inter-circuit heat exchanger, and a thermostatic expansion valve at the inlet of the evaporator; and (c) including a thermostatic expansion valve at the inlet of the evaporator.

The present methods, including each of System Forming Methods 1-26, includes methods in which the existing centralized refrigeration system includes a rack of compressors comprising at least two compressors.

The present methods, including each of System Forming Methods 1-26, includes methods in which the existing centralized refrigeration system includes at least about 5 evaporators.

The present methods, including each of System Forming Methods 1-26, includes methods in which the existing centralized refrigeration system includes at least about 5 evaporators operating to provide medium temperature refrigeration.

The present methods, including each of System Forming Methods 1-26, includes methods in which the existing centralized refrigeration system includes at least about 5 evaporators operating to provide medium temperature refrigeration in association with at least 5 display cases.

The present methods, including each of System Forming Methods 1-26, includes methods in which the existing centralized refrigeration system includes at least about 5 evaporators operating to provide medium temperature refrigeration in association with at least 5 open display cases.

The present methods, including each of System Forming Methods 1-26, includes methods in which: (1) the existing centralized refrigeration system includes at least about 5 evaporators operating to provide medium temperature refrigeration in association with at least 5 open display cases; and (2) the new second circuit refrigeration system comprises at least one of said 5 open display cases being converted to a closed display case.

The present methods, including each of System Forming Methods 1-26, includes methods in which: (1) the existing centralized refrigeration system includes at least one evaporator operating to provide medium temperature refrigeration in association with at least one open display case; and (2) the new second circuit refrigeration system comprises said at least one open display case being converted to a closed display case.

The present methods, including each of System Forming Methods 1-26, includes methods in which: (1) the existing centralized refrigeration system includes at least one evaporator operating to provide medium temperature refrigeration in association with at least one open display case; and (2) the new second circuit refrigeration system comprises: (i) said at least one open display case being converted to a closed display case; and (ii) a liquid pump fluidly connected between the liquid second refrigerant exiting the inter-circuit heat exchanger and the inlet of said at least one second circuit evaporator.

The present methods, including each of System Forming Methods 1-26, includes methods in which: (1) the existing centralized refrigeration system includes at least one evaporator operating to provide medium temperature refrigeration in association with at least one open display case; and (2) the new second circuit refrigeration system comprises: (i) said at least one open display case being converted to a closed display case; (ii) a liquid pump fluidly connected between the liquid second refrigerant exiting the inter-circuit heat exchanger and the inlet of the said at least one second circuit evaporator and (iii) a liquid ejector fluidly connected between the vapor exiting the at least one second refrigerant evaporator and the inlet to the inter-circuit heat exchanger.

The present methods, including each of System Forming Methods 1-26, includes methods in which: (1) the existing centralized refrigeration system includes at least one evaporator operating to provide medium temperature refrigeration in association with at least one open display case; and (2) the new second circuit refrigeration system comprises: (i) said at least one open display case being converted to a closed display case; (ii) a liquid pump fluidly connected between the liquid second refrigerant exiting the inter-circuit heat exchanger and the inlet of said at least one second circuit evaporator and (iii) a thermostatic expansion valve at the inlet of the at least one evaporator.

The present methods, including each of System Forming Methods 1-26, includes methods in which: (1) the existing centralized refrigeration system includes at least one evaporator operating to provide medium temperature refrigeration in association with at least one open display case; and (2) the new second circuit refrigeration system comprises: (i) said at least one open display case being converted to a closed display case; (ii) a liquid pump fluidly connected between the liquid second refrigerant exiting the inter-circuit heat exchanger and the inlet of the at least one second circuit evaporator; (iii) a thermostatic expansion valve at the inlet of the at least one evaporator; and (iv) a liquid ejector fluidly connected between the vapor exiting the at least one second refrigerant evaporator and the inlet to the inter-circuit heat exchanger.

EXAMPLES

The following examples are provided for the purpose of illustrating the present invention but without limiting the scope thereof.

For the evaluation of possible methods to improve an existing centralized refrigeration system to be more environmentally friendly, including for comparison purposes by essentially removing the entire charge of the existing high GWP refrigerant and replacing it with a lower GWP refrigerant, it is important to consider performance parameters such as: (1) the volumetric flow rate of the refrigerant in the system to achieve the same cooling capacity; (2) the mass flow rate of the refrigerant in the system to achieve the same cooling capacity; (3) the density of the refrigerant; and (4) the pressure loss ratio.

Comparative Example C1—Large Capacity Centralized Refrigeration System Using R-404A as Refrigerant in a Medium Temperature Application A large capacity (i.e., cooling capacity of 243 kW) direct expansion centralized refrigeration system of the type disclosed in FIG. 1 is provided with R-404A as the existing refrigerant. The system operating conditions using R-404A as the refrigerant in the system of FIG. 1 are:

Cooling capacity: 243 kW
Isentropic efficiency: 0.7
Volumetric efficiency: 1
Condensing temperature: 56.85° C.
Subcooling: 5° C.
Superheat: 10° C.
Evaporating temperature: −3.15° C.

Based on the volumetric flow rate establishing a base-line value of 0.1 $m^3/s$, the system operating conditions are a density of 26.8 $kg/m^3$ and a mass flow rate of 2.68 kg/sec. While this system operates well from the standpoint of thermodynamic and heat transfer performance, it is highly undesirable from the standpoint of its environmental impact since the entire system contains the high GWP refrigerant R404A circulating throughout the entirety of a large and complex piping network.

Comparative Example C2—Large Capacity Centralized Refrigeration System Using R-471A as to Replace R-401A in a Medium Temperature Application Comparative Example 1 is repeated, except that all of the R-404A refrigerant is removed from the system and, without making any other changes to the system, the R-404A refrigerant is replaced with the low GWP refrigerant R-471A. In particular, R-471A is a refrigerant consisting of the following components in the following relative amounts:

| | Wt. % |
|---|---|
| R 471A Component | |
| 1234ze(E) | 78.7 |
| 1336mzz(E) | 17 |
| R227ea | 4.3 |
| Property | |
| GWP (per IPCC AR5) | 148 |

However, making this replacement does not achieve the primary goal of maintaining performance while minimizing environmental impact. In particular, based on the same operating conditions as specified in Comparative Example 1, a substantial and undesirable change in refrigerant volumetric flow rate, mass flow rate density and pressure loss ratio results from simply replacing the R404A with R471A in this manner, as indicated in Table C2 below:

TABLE C2

| Example | Fluid | Volumetric flow rate "f" (m3/s) | Mass flow rate (kg/s) | Density "D" (kg/m3) | Pressure loss ratio $(D_{R471A}/D_{R404A})$* $(f_{R471A}/f_{R404A})$^2 |
|---|---|---|---|---|---|
| C1 | R404A | 0.1 | 2.68 | 26.8 | — |
| C2 | R471A | 0.25 | 2.34 | 9.4 | 2.19 |

As can be seen from the results in Table C2 above, exchanging R-417A for the existing R-404A improves the system from the standpoint of containing a low GWP refrigerant, but creates unacceptable performance in terms of a high (i.e., above 1) pressure loss ratio, which means the compression system performance is significantly degraded. In addition, this high-pressure loss ratio means that the existing piping would not be suitable for continued operation of the system and that continuing reliable system operation would require dismantling and replacing the old piping network, and possibly other significant system modifications.

Comparative Example C3—Large Capacity Centralized Refrigeration System Using R-1234ze to Replace R-404A in a Medium Temperature Application Comparative Example 1 is repeated, except that all of the R-404A refrigerant is removed from the system and, without making any other changes to the system, is replaced with the low GWP refrigerant 1234ze(E) or 1234yf. While the use of R-1234ze(E) or R-1234yf improves the system from the standpoint of containing a low GWP refrigerant (less than 1), it is nevertheless a solution with the drawback that neither refrigerant is nonflammable.

Comparative Example C4—Large Capacity Centralized Refrigeration System Using CO2 to Replace R-404A in a Medium Temperature Application Comparative Example 1 is repeated, except that all of the R-404A refrigerant is removed from the system and, without making any other changes to the system, is replaced with the low GWP refrigerant CO2. While the use of CO2 improves the system from the standpoint of containing a low GWP refrigerant, it is nevertheless an unacceptable solution for several reasons. First, CO2 is a very high-pressure fluid compared to R404A, and as a result the R-404A piping will not successfully contain the CO2. Second, even if all of the piping were to be replaced, which is a costly and undesirable requirement, in CO2 systems a complete release of all CO2 to the atmosphere would be required in the event of a system break down, which would in turn lead to high CO2 emission and food loss in the display cabinet. Third, CO2 as direct expansion refrigerant replacement in such systems results in poor efficiency (COP) at medium and high temperature ambient conditions, which in turn leads to a high electricity consumption and high indirect CO2 emissions.

Figure 2:
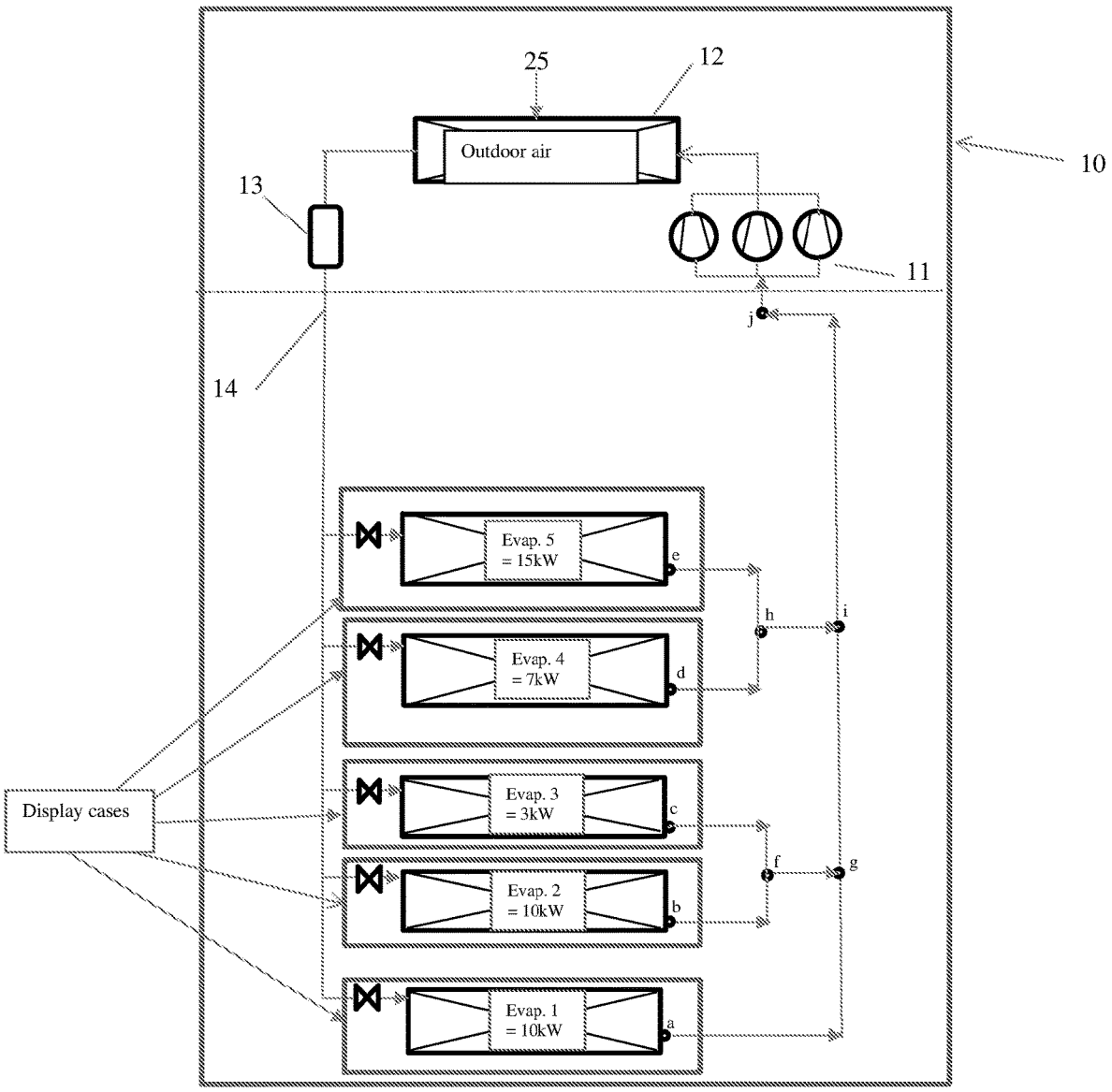
FIG. 2 is semi-schematic representation of an exemplary starting centralized refrigeration system used in the heat transfer system formation methods of the present invention.
Figure 3A:
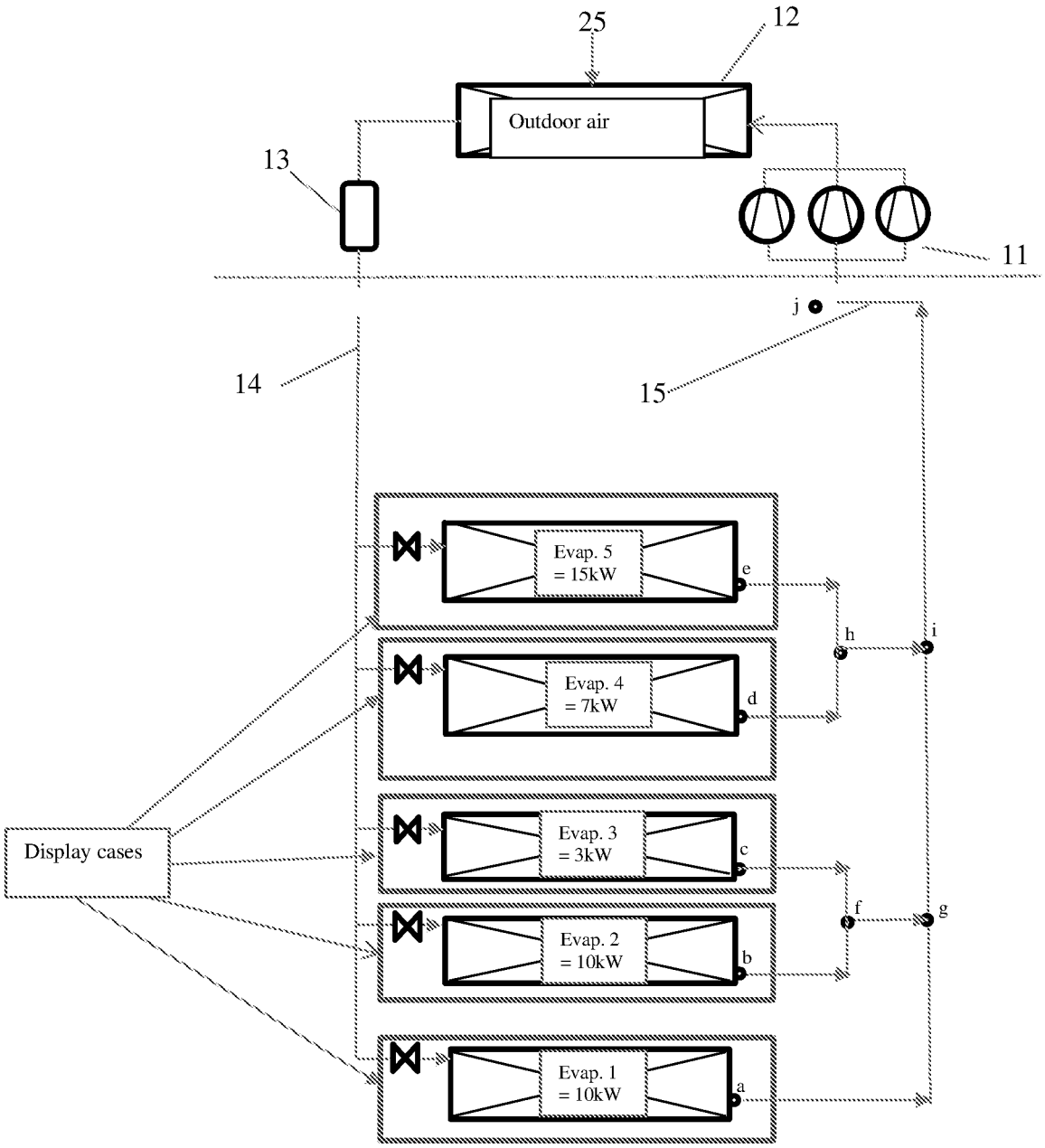
FIG. 3A is a schematic representation of an exemplary starting centralized refrigeration system showing disconnection points in the process of forming a heat transfer system of the present invention.

Comparative Example C5—Centralized Refrigeration System Using R-404A as Refrigerant in a Medium Temperature Application A direct expansion centralized refrigeration system having a cooling capacity of 45 kW in a medium temperature refrigeration application, as illustrated schematically in FIG. 2, is provided with the R-404A as the existing refrigerant. The system comprises a refrigeration circuit 10 comprising a rack of compressors (three compressors are illustrated, but any number of compressor(s) can be used according to particular design considerations to meet the compression capacity needed for each particular system). The R-404A refrigerant vapor discharged from the compressor(s) in rack 11 feeds a condenser 12 (which may comprise a plurality of condensers) that uses ambient outdoor air to absorb heat from the refrigerant vapor and condense it. Heated air is then expelled to ambient. The refrigerant liquid exits the condenser and enters accumulator 13 which contains a supply of liquid refrigerant to feed the evaporators (Evap. 1-5) in their respective display cases. The dotted line in FIG. 2 represents that the compressor rack 11, the condenser 12 and the accumulator 13 are located remotely (and preferably with restricted access by the public) from the location of the display cases. The operating conditions for the portions of the circuit involving the compressors and the condenser are provided below:

Condensing pressure: 2558 kPa

Condensing temperature: 55° C.

Evaporating pressure: 439 kPa

Evaporating temperature: −10° C.

Liquid refrigerant feed pipe(s) 14 transport the liquid refrigerant over large distances at a high pressure of about 2585 kPa, and the combination of the long transport distances and high-pressure result in a high rate of refrigerant leakage. The liquid refrigerant reaches the inlet of an expansion value for each of the evaporators, and each evaporator is designed to provide the indicated level of medium temperature cooling, as reported in Table CE5 below, together with other operating conditions for this portion of the system:

TABLE CE5

| Display cabinets | | | |
|---|---|---|---|
| Evap. No. | Temp. of Refrig. In Evaporator | Target Temp. in Cabinet | Capacity (KW) |
| 1 | −10° C. | 2° C. | 10 |
| 2 | −10° C. | 2° C. | 10 |
| 3 | −10° C. | 2° C. | 3 |
| 4 | −10° C. | 2° C. | 7 |
| 5 | −10° C. | 2° C. | 15 |

The system piping on the evaporator vapor outlet side, which is not illustrated in FIG. 2 to scale, is referenced to nodes a through j in FIG. 2 and carries refrigerant vapor at pressure of about 439 kPa. As with the liquid lines, the large distance the piping covers to return the vapor to the compressor rack coupled with the relatively high pressure of 439 kPa results in a high rate of refrigerant leakage on the vapor side of the system as well. The length of piping between the nodes, and the size of copper piping between each node, are noted below in Table CE5C:

TABLE CE5C

| From node | To node | Length, m | Pipe Diameter between nodes |
|---|---|---|---|
| a | g | 10 | 1⅛" |
| b | f | 3 | 1⅛" |
| c | f | 8 | ¾" |
| f | g | 10 | 1⅛" |
| g | i | 5 | 1⅛" |
| d | h | 3 | ¾" |
| e | h | 5 | 1⅛" |
| h | i | 15 | 1⅜" |
| i | j | 10 | 1⅝" |

Example 1A—Formation of a Centralized Refrigeration by Modifying Original System Using R-404A and Replacing R404A with Refrigerant A1 (R-471A)

The heat transfer system of Comparative Example 5, including the existing refrigerant R404A contained therein, is used as the starting point for the formation of an improved heat transfer system. Modification of the system is described first in connection with FIG. 3A. The portion of the system containing the condenser 12, the compressor rack 11 and the accumulator 13 is disconnected from the display cases, preferably close to where the compressor rack and accumulator are located, for example by cutting the liquid line 14 leading from the accumulator and by cutting the vapor riser 15 leading to the compressor rack. The R404A located in this portion of the system need not be removed but optionally can be removed. For this example, the refrigerant in this portion of the system (above the dotted line) is not removed and is used in the modified system. However, the R404A located in the remainder of the system (below the dotted line) is removed from all of the remaining refrigerant conduits and all the evaporators.

Figure 3B:
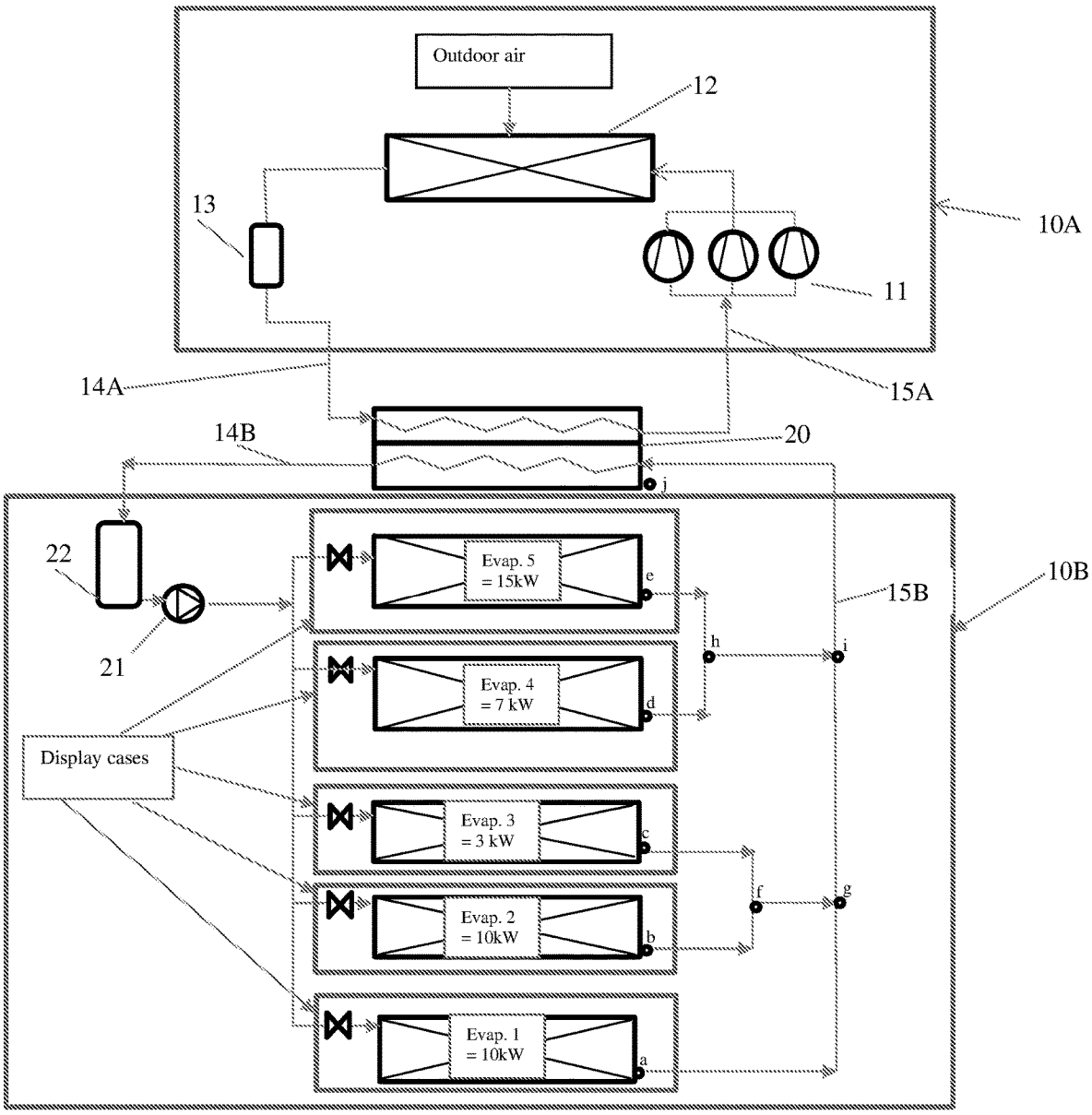
FIG. 3B is a schematic representation of a completed exemplary centralized refrigeration system made in accordance with heat transfer system forming methods of the present invention.

As shown in FIG. 3B, the system is then reconfigured as a first heat transfer system 10A using the original R404A (or other high GWP refrigerant that has been commonly used for centralized systems) and a second heat transfer circuit 10B which comprises the evaporators 1-5 and which uses a new low GWP refrigerant according to the present invention, which in this Example 1 is R471A. A new heat exchanger 20 thermally interconnects the first heat transfer circuit 10A to the second heat transfer circuit 10B by transporting the liquid R404A refrigerant from the accumulator, preferably over a relatively short distance in conduit 14A, to inter-circuit heat exchanger 20, where is absorbs heat from the new refrigerant in the second circuit and is evaporated. The evaporated R-404A is then returned to the suction side of the compressor rack via conduit 15A, which preferably also extends over a relatively short distance.

A liquid pump 21 is added to the second circuit system to provide the motive force to deliver the low GWP refrigerant R471A to each of the evaporators via respective conduits and valves. In each evaporator the R471A refrigerant provides cooling to its respective display case as it evaporates in thermal contact with the relatively warmer air in the display case. The R471A vapor exiting from the evaporators 1-5 is then manifolded to riser 15B, where it is transported to the inter-circuit heat exchanger 20 and where it rejects heat to the liquid R-404A from the first circuit and in so doing condenses back to liquid. Liquid R471A from the heat exchanger 20 travels via conduit 14B to accumulator 22, which in turn provides a source of liquid R471A to pump 21.

The R471A refrigerant in the second circuit operates as a two-phase coolant between the condenser, where it condenses at about −6° C. as a saturated liquid and a condenser pressure of about 160 kPa), and in each of the evaporators the R471a evaporates at a temperature of about −3° C., with a mean evaporating temperature of about −2° C. The R471A evaporates completely in each evaporator and the return flow of refrigerant R471A vapor through riser 15B is at saturated or superheated state.

The following Table E1 demonstrates that using existing piping from the original R404A centralized system allows the modified system to achieve the same level of cooling in each evaporator utilizing a very large proportion of low GWP refrigerant R471A in the second circuit and to operate with pressure losses sufficiently low to permit effective operation of the heat transfer circuit:

TABLE CE5C

| From node | To node | Length, m | Pipe Diameter between nodes | Pressure at exit nodes (kPa) |
|---|---|---|---|---|
| a | g | 10 | 1⅛" | 175.3 |
| b | f | 3 | 1⅛" | 178.3 |
| c | f | 8 | ¾" | 176.6 |
| f | g | 10 | 1⅛" | 172.1 |
| g | i | 5 | 1⅛" | 167.3 |
| d | h | 3 | ¾" | 174.8 |
| e | h | 5 | 1⅛" | 175.3 |
| h | i | 15 | 1⅜" | 168.4 |
| i | j | 10 | 1⅝" | 160.8 |

As can be seen from the Table E1 above, the vapor return pressure at node 10, which corresponds to the R471A inlet to the inter-circuit heat exchanger, is 160.8 kPa. Since the condenser operates at 160 kPa, the pressure at the inlet of the condenser ensures proper and continuing operation of the second circuit using the existing piping network.

Example 1B—Formation of a Centralized Refrigeration by Modifying Original System Using R-404A and Replacing R404A with Refrigerant A2 (R476A)

Example 1A is repeated, except that the R-404A refrigerant is replaced with the low GWP refrigerant designated below as Refrigerant A2 herein, which consists of the following components in the following relative amounts:

Refrigerant A2

| Component | Wt. % |
|---|---|
| 1234ze(E) | 78 |
| 1336mzz(E) | 12 |
| R134a | 10 |

Property

| | |
|---|---|
| GWP (per IPCC AR5) | 133 |

Acceptable pressure drop performance similar to Example 1 is achieved.

Example 1C—Formation of a Centralized Refrigeration by Modifying Original System Using R-404A and Replacing R404A with Refrigerant A3

Example 1A is repeated, except that the R-404A refrigerant is replaced with the low GWP refrigerant designated below as Refrigerant A3, which consists of the following components in the following relative amounts:

Refrigerant A3

| Component | Wt. % |
|---|---|
| 1234ze(E) | 83.5 |
| 1224yd(Z) | 13 |
| R134a | 10 |

Property

| | |
|---|---|
| GWP (per IPCC AR5) | 131 |

Acceptable pressure drop performance similar to Example 1 is achieved.

Example 1C'—Formation of a Centralized Refrigeration by Modifying Original System Using R-404A and Replacing R404A with Refrigerant A3'

Example 1A is repeated, except that the R-404A refrigerant is replaced with the low GWP refrigerant designated below as Refrigerant A3', which consists of the following components in the following relative amounts:

Refrigerant A3'

| Component | Wt. % |
|---|---|
| 1234ze(E) | 77 |
| 1224yd(Z) | 13 |
| R134a | 10 |

Property

| | |
|---|---|
| GWP (per IPCC AR5) | 131 |

Acceptable pressure drop performance similar to Example 1 is achieved.

| Component | Wt. % |
|---|---|
| 1234ze(E) | 77 |
| 1224yd(Z) | 13 |
| R134a | 10 |

Property

| | |
|---|---|
| GWP (per IPCC AR5) | 131 |

Acceptable pressure drop performance similar to Example 1 is achieved.

Figure 4:
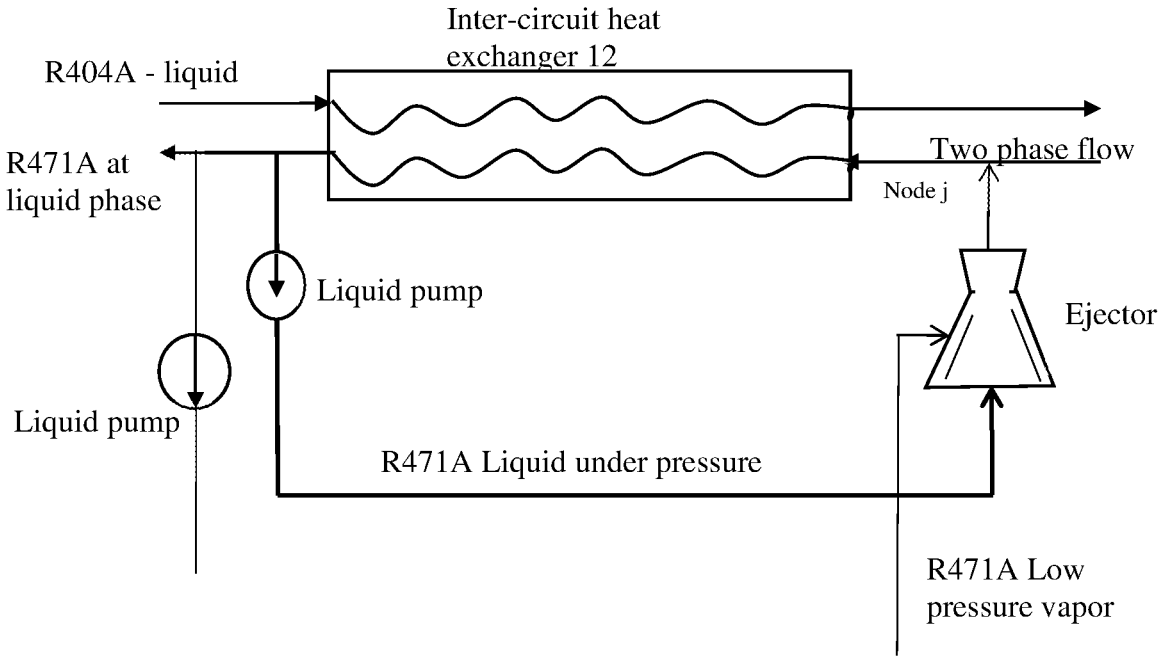
FIG. 4 is a schematic representation of process flow described in Example 1D.

Example 1D—Formation of a Centralized Refrigeration by Modifying Original System Using R-404A and Replacing R404A with Refrigerant A1 (471A) and Adding Liquid Ejector Each of Examples 1A, 1B, 1C and 1C' is repeated except that the length of piping between node i and j is 28 meters instead of 10 meters, and a liquid injector is added at the condenser inlet as illustrated in FIG. 4 hereof.

Because of the increase length of vapor return piping in this case, and without any other changes in the system of Example 1, the pressure at node j would be below the design pressure at the inlet to the inter-circuit heat exchanger. To overcome such a situation, a liquid ejector is added to the system and has its motive fluid inlet controllably connected to the ejector liquid inlet and to the vapor from node I. The following acceptable operating conditions, or similar acceptable conditions, are achieved:

| | Pressure (kPa) |
|---|---|
| Node 10, Ejector vapor phase pressure | 148.2 |
| Ejector Liquid inlet pressure | 639 |
| Ejector two phase flow pressure | 160.55 |

Comparative Example 6—Operation of Centralized Refrigeration System Operating with R-404A A large capacity (i.e., cooling capacity of 189 kW) direct expansion centralized supermarket medium temperature display case refrigeration system of the type disclosed in FIG. 1 is provided with the R-404A as the existing refrigerant. The system has the following operating parameters, emissions parameters and ambient conditions:

Operating Parameters

Life span: 10 years

Number of trading and non-trading hours: 14/10 respectively

Installed cooling capacities: 189 kW

Running conditions (Tevap, min. Tcond):

Tevap=−8° C.;

Min. Tcond=10° C.

Air cooled condenser=45 kW/Kw

Air cooled dry cooler=45 kW/Kw

Temperature Difference between condensing temperature and ambient air −8° Kelvin Emissions Leak rate=15% annually CO2 emissions per kWh=430 gram of CO2/kWh (ref: coal ~1000 gr. CO2/kWh, nuclear ~50 gr. CO2/kWh)

Ambient Conditions

Climate conditions used in the model are as follows (ex: London):

| | January | February | March | April | May | June |
|---|---|---|---|---|---|---|
| Ambient day (° C.) | 2.58 | 5.72 | 8.19 | 11.85 | 20.08 | 22.26 |
| Ambient night (° C.) | −0.58 | 1.56 | 1.93 | 5.62 | 10.67 | 14.52 |

| | July | August | September | October | November | December |
|---|---|---|---|---|---|---|
| Ambient day (° C.) | 22.16 | 21.85 | 22.50 | 11.96 | 6.69 | 5.62 |
| Ambient night (° C.) | 15.32 | 13.81 | 14.25 | 7.80 | 1.85 | 2.42 |

Cooling Load Distribution

100% of the total installed cooling capacity during the day,

50% of the total installed cooling capacity during the night.

Performances of Compressors and Condenser Fans

COP of compressors is evaluated based on running conditions (Tevap, Tcond, superheat)

Energy consumption of the condenser=(heat that needs to be rejected in the condenser)/(energy efficiency of the condenser).

Energy consumption of display cabinets is based on energy consumption of the fans, lighting and defrost heater (if applicable); defrost heater operates 2 times per 24 h.

The system operation as defined in this example defines base-line conditions (100%) for electricity consumption and CO2 total emissions in comparison to the Examples that follow.

Example 2A—Modification and Operation of Modified Centralized Refrigeration System of Comparative Example 6 Using R-1234ze(E) and A1 (R-471A)

The system described in Comparative Example 6 is modified in accordance with the present invention. With general reference to FIGS. 2A-2C, the liquid line 14 from the accumulator is disconnected to separate the liquid side of the evaporators from the liquid from the condenser 12, and the vapor line 15 is disconnected so as to separate the vapor side of the evaporator(s) from the compressor(s) to produce a new first refrigeration circuit and a new second refrigeration circuit as described herein, including generally in connection with FIGS. 2A-2C. The existing R-404A refrigerant is removed in its entirety, and R-1234ze(E) is used in the new first circuit and R-471A is used in the new second circuit. A liquid pump 21 and an inter-circuit heat exchanger are added as described herein and illustrated in FIG. 3 are added to the new second system, and openable closures are added to the refrigeration display cases, but the piping remains largely unchanged.

The interconnected new first and second refrigeration circuits are then operated and achieve the advantages described in the table below:

| System | Electricity consumption % | CO2 total emissions % |
|---|---|---|
| Comparative Example 6 (R-404A refrigerant) | 100 | 100 |
| New First Circuit (with R-1234ze) and New Second Circuit (with R-471A) | 99 | 63.4 |

As can be seen from the table above, as substantial improvement in CO2 emissions is achieved, without any new electricity consumption. This is a significant and unexpected advantage.

Example 2B—Modification and Operation of Modified Centralized Refrigeration System of Comparative Example 6 Using R-1234ze(E) and A2 (R476A)

Example 2A is repeated except that refrigerant A2 as describe above is used in place of refrigerant A1. Similar favorable and unexpected results are achieved.

Example 2C—Modification and Operation of Modified Centralized Refrigeration System of Comparative Example 6 Using R-1234ze(E) and A3

Example 2A is repeated except that refrigerant A3 as describe above is used in place of refrigerant A1. Similar favorable and unexpected results are achieved.

Example 2C'—Modification and Operation of Modified Centralized Refrigeration System of Comparative Example 6 Using R-1234ze(E) and A3'

Example 2A is repeated except that refrigerant A3' as describe above is used in place of refrigerant A1. Similar favorable and unexpected results are achieved.

Example 2D—Modification and Operation of Modified Centralized Refrigeration System of Comparative Example 6 Using R-454C and A1

Example 2A is repeated except that refrigerant R454C is used in place of R1234ze(E). Similar favorable and unexpected results are achieved.

Example 2E—Modification and Operation of Modified Centralized Refrigeration System of Comparative Example 6 Using R-455A and A3

Example 2A is repeated except that refrigerant R455A is used in place of R1234ze(E). Similar favorable and unexpected results are achieved.

Example 3A—Modification and Operation of Modified Centralized Refrigeration System of Comparative Example 6 Using R-1234ze(E) and A1 (R-471A) and Water-Cooled Condenser Example 2A is repeated, except that a water-cooled condenser is used instead of an air-cooled condenser. Similar favorable and unexpected results are achieved.

Example 3B—Modification and Operation of Modified Centralized Refrigeration System of Comparative Example 6 Using R-1234ze(E) and A2 (R476A) and Water-Cooled Condenser Example 2B is repeated, except that a water-cooled condenser is used instead of an air-cooled condenser. Similar favorable and unexpected results are achieved.

Example 3C—Modification and Operation of Modified Centralized Refrigeration System of Comparative Example 6 Using R-1234ze(E) and A3 and Water-Cooled Condenser Example 2C is repeated, except that a water-cooled condenser is used instead of an air-cooled condenser. Similar favorable and unexpected results are achieved.

Example 3C'—Modification and Operation of Modified Centralized Refrigeration System of Comparative Example 6 Using R-1234ze(E) and A3' and Water-Cooled Condenser Example 2C' is repeated, except that a water-cooled condenser is used instead of an air-cooled condenser. Similar favorable and unexpected results are achieved.

Comparative Example 7—Modification and Operation of Modified Centralized LT and MT Refrigeration System Using R-404A and Replacing with R-1234ze(E) and A1 (R471A)

A large capacity direct expansion centralized supermarket medium temperature display case refrigeration system of the type illustrated in FIG. 1 and described in Comparative Example 6 is provided in parallel with a low temperature refrigeration system running on R455A refrigerant. The MT system has the same operating parameters, emissions parameters and ambient conditions as disclosed in Comparative Example 6, and the low temperature system operates under the following conditions:

Operating Parameters

Capacity: 30 kW

Tevap=−32° C. (using R-455a or $CO_2$);

Temperature Difference between condensing temperature and ambient air −8° Kelvin The system operation as defined in this example defines base-line conditions (100%) for electricity consumption and CO2 total emissions in comparison to Example 4 that follows.

Example 4A—Modification and Operation of Modified Centralized Refrigeration System of Comparative Example 7 Using R-1234ze(E) and A1 (R-471A)

Figure 5:
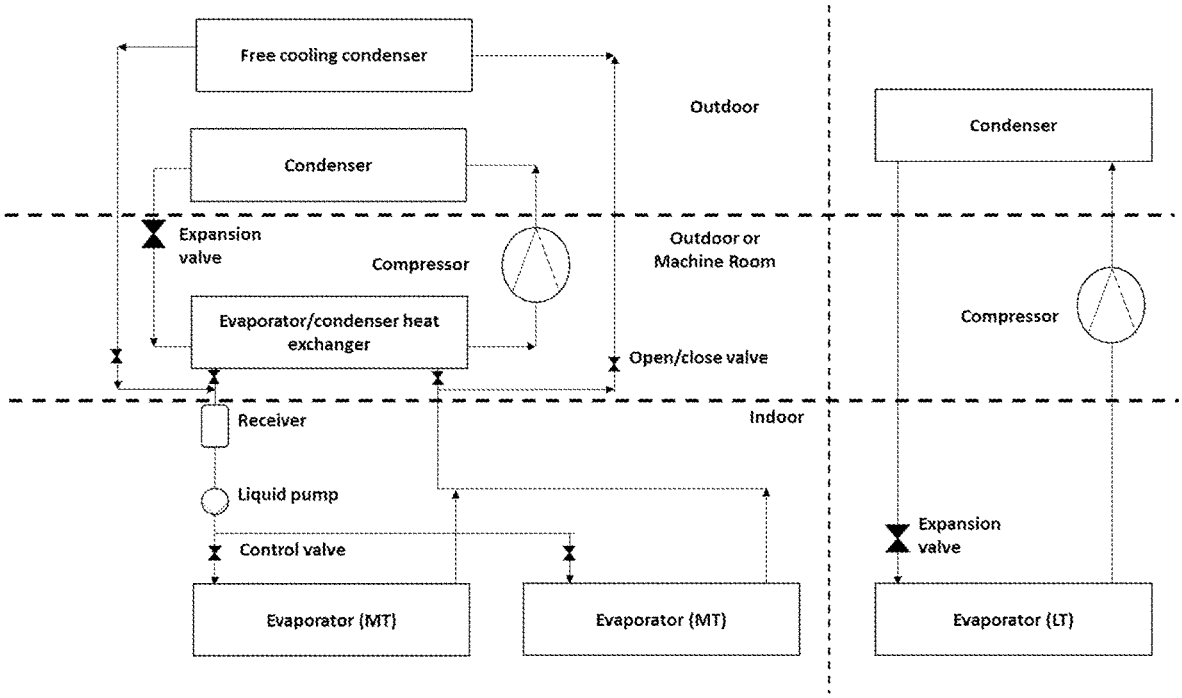
FIG. 5 is a schematic representation of process flow described in Example 4A.

The MT system of Comparative Example 7 is modified as described in Example 2A above, interconnected then operated in parallel with the LT system as illustrated in the FIG. 5.

The MT system has the same operating parameters, emissions parameters and ambient conditions as disclosed in Comparative Example 6, and the lower temperature system operates under the conditions specified in Comparative Example 7. The new first and second refrigeration circuits are then operated and achieve the advantages described in the table below:

| System | Electricity consumption % | CO2 total emissions % |
|---|---|---|
| Comparative Example 7 (R-404A refrigerant) | 100 | 100 |
| New First Circuit (with R-1234ze) and New Second Circuit (with R-471A) of MT system and R455A in LT system | 96.9 | 66.2 |

As can be seen from the table above, as substantial improvement in CO2 emissions is achieved while simultaneously achieving an approximate 3% reduction in electricity consumption. This is a significant and unexpected advantage.

Example 4B—Modification and Operation of Modified Centralized Refrigeration System of Comparative Example 7 Using R-455A and A1 (R-471A)

Example 4A is repeated except that R-455A is used instead of R-1234ze(E). The results are shown in the following table:

| Architectures (air cooled condenser) | Electricity consumption % | CO2 total emissions % |
|---|---|---|
| R-404A | 100 | 100 |
| R-455A in first circuit, R-471A in second circuit of MT and R455A in LT | 97.8% | 67.6% |

Example 4C—Modification and Operation of Modified Centralized Refrigeration System of Comparative Example 7 Using R-454C and A1 (R-471A)

Example 4A is repeated except that R-454C is used instead of R-1234ze(E). The results are shown in the following table:

| Architectures (air cooled condenser) | Electricity consumption % | CO2 total emissions % |
|---|---|---|
| R-404A | 100 | 100 |
| R-454 in first circuit, R-471A in second circuit of MT and R455A in LT | 96.4% | 65.9% |

Example 4D—Modification and Operation of Modified Centralized Refrigeration System of Comparative Example 7 Using R-290 and A1 (R-471A)

Example 4A is repeated except that R-290 is used instead of R-1234ze(E). The results are shown in the following table:

| Architectures (air cooled condenser) | Electricity consumption % | CO2 total emissions % |
|---|---|---|
| R-404A | 100 | 100 |
| R-290 in first circuit, R-471A in second circuit of MT and R455A in LT | 98.4% | 68.0% |

The invention claimed is:

1. A method for forming an improved, centralized refrigeration system comprising:

(a) providing an existing refrigeration circuit comprising: (i) an existing refrigerant having a GWP of greater than 1200; (ii) a plurality of evaporators located in or near a refrigerated space containing products accessible to consumers and (ii) at least one compressor or rack of compressors and at least one condenser located remotely from areas accessible to said consumers, wherein said existing refrigerant from said condenser is fluidly connected to said evaporators via conduit(s) and wherein existing refrigerant vapor from said evaporators is returned via conduits to a suction side of said compressor or compressor rack;

(b) disconnecting the fluid connection between said existing refrigerant liquid from said condenser and at least one of said evaporators;

(c) disconnecting the fluid connection between said existing refrigerant vapor from said at least one of said evaporators in step (b) and said suction of said compressor or compressor rack;

(d) establishing a new first refrigeration circuit comprising said compressor or compressor rack and said condenser, wherein said existing refrigerant remains in said first refrigeration circuit or wherein said existing refrigerant is at least partially removed and replaced;

(e) establishing a new second refrigeration circuit comprising said at least one of said evaporators that has been disconnected in steps (b) and (c) by steps comprising: (i) removing said existing refrigerant from said evaporators and at least a portion of said conduits which have been disconnected in steps (b) and (c); (ii) replacing said removed existing refrigerant with a second refrigerant comprising: (1) at least about 50% by weight of R1234ze(E); (2) greater than 0% to about 10% of a second component, wherein said second component is selected from the group consisting of HFC-134a, HFC-134, HFC-227ea, HFC-125, and combinations of two or more of these; and (3) from about 10% to about 20% by weight of a third component, wherein said third component is selected from the group consisting of HFO-1336mzz(E), HFO-1224 yd(Z), and combinations of these, wherein said second refrigerant: (i) has an Occupational Exposure Limit (OEL) greater than 400; (ii) is classified as class A1 by ASHRAE Standard 34; and (iii) has a GWP of about 150 or less; and (f) thermally interconnecting said new first refrigeration circuit and said new second refrigeration circuit with an inter-circuit heat exchanger in which at least a portion of said refrigerant in said first circuit is vaporized by absorbing heat from said second circuit refrigerant vapor and wherein at least a portion of said second refrigerant is condensed by transferring heat to said first circuit refrigerant.

2. The method of claim 1 wherein said second refrigerant has a glide of 5° K or less.

3. The method of claim 1 wherein said second refrigerant has a glide of 4° K or less.

4. The method of claim 1 wherein said second refrigerant has a glide of 3° K or less.

5. The method of claim 1 wherein said second refrigerant has a normal boiling point of from −40° C. to 20° C.

6. The method of claim 1 wherein said second refrigerant has a normal boiling point of from −20° C. to 20° C.

7. The method of claim 1 wherein said second refrigerant has a normal boiling point of from −20° C. to −12° C.

8. The method of claim 1 wherein said second refrigerant comprises R741A.

9. The method of claim 8 wherein said existing refrigerant is R404A.

10. The method of claim 1 wherein said second refrigerant comprises R476A.

11. The method of claim 9 wherein said existing refrigerant is R404A.

12. The method of claim 1 wherein said second refrigerant comprises about 83.5% by weight of HFO-1234ze(E), about 6.5% by weight of HFO-1224yd(Z) and about 10% by weight of HFC-134a.

13. The method of claim 10 wherein said existing refrigerant is R404A.

14. The method of claim 1 wherein said existing refrigerant is selected from R404A, R407, R448, R449, R454, R513, R455 and R22.

15. The method of claim 1 wherein said existing refrigerant is R404A.

16. The method of claim 1 wherein said step of establishing a new first refrigeration circuit comprises removing at least a portion of said existing refrigerant from said new first refrigeration circuit and replacing replaced at least a portion of said removed existing refrigerant by a new first refrigerant having a GWP less than that of said existing refrigerant.

17. The method of claim 16 wherein said new first refrigerant comprises HFO-1234yf and/or 1234ze(E).

18. The method of claim 16 wherein said new first refrigerant comprises a blend comprising HFO-1234yf.

19. The method of claim 16 wherein said new first refrigerant is R513.

20. The method of claim 19 wherein said R513 is R513A.

21. The method of claim 16 wherein said new first refrigerant is a combination of HFO-1234yf and R134a.

* * * * *